US010684094B2

(12) United States Patent
Shinkle

(10) Patent No.: US 10,684,094 B2
(45) Date of Patent: Jun. 16, 2020

(54) ADJUSTABLE HOLSTER FOR A FIREARM

(71) Applicant: SIG SAUER, INC., Newington, NH (US)

(72) Inventor: Scott Shinkle, Greenland, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 16/171,647

(22) Filed: Oct. 26, 2018

(65) Prior Publication Data

US 2019/0128640 A1 May 2, 2019

Related U.S. Application Data

(60) Provisional application No. 62/578,001, filed on Oct. 27, 2017.

(51) Int. Cl.
*F41C 33/04* (2006.01)
*F41C 33/02* (2006.01)

(52) U.S. Cl.
CPC ..... *F41C 33/041* (2013.01); *F41C 33/0209* (2013.01); *F41C 33/0263* (2013.01); *F41C 33/048* (2013.01)

(58) Field of Classification Search
CPC F41C 33/041; F41C 33/0209; F41C 33/0263; F41C 33/048
See application file for complete search history.

(56) References Cited

U.S. PATENT DOCUMENTS 3,276,646 A * 10/1966 Coggins, Jr. ..... A45F 5/00 224/579
5,931,358 A * 8/1999 Rogers ..... F41C 33/02 224/243
7,314,152 B1 * 1/2008 Garrett ..... F41C 33/0236 224/192
2009/0001117 A1 * 1/2009 Rassias ..... F41C 33/0236 224/673
2011/0132943 A1 * 6/2011 Edelman ..... F41C 33/041 224/243

OTHER PUBLICATIONS

Dave Higginbotham, "OWB or IWB with the Blade Tech Eclipse Straight Drop Ambi Holster", GunsAmerica News and Reviews, Jul. 30, 2014, retrieved online from URL: https://www.gunsamerica.com/blog/owb-iwb-blade-tech-eclipse on Jan. 10, 2017, 11 pages.
"Handgun Holster", Wikipedia, retrieved online from URL: https://en.wikipedia.org/wiki/Handgun_holster, retrieved on Jan. 10, 2017, 9 pages.

* cited by examiner

*Primary Examiner* — Corey N Skurdal
(74) *Attorney, Agent, or Firm* — Finch & Maloney PLLC

(57) ABSTRACT

Disclosed are assemblies and components of an adjustable holster. The holster includes a holster body that defines a cavity to receive a firearm. One or more clips can be hingedly attached to the holster body. In some embodiments, each clip can be removably attached to a hinge pin on the holster body. Based on the configuration and location of the clip(s), the disclosed assemblies can be configured as either a right-hand or left-hand holster assembly, as an inside-the-waist-band holster or an outside-the-waist-band holster, and/or as a holster with a canted or non-canted orientation. The holster can be reconfigured without tools in some embodiments.

25 Claims, 22 Drawing Sheets

ADJUSTABLE HOLSTER FOR A FIREARM

RELATED APPLICATIONS

This application claims priority under 35 U.S.C. § 119(e) to U.S. Provisional Patent Application No. 62/578,001 titled ADJUSTABLE HOLSTER FOR A SIDEARM and filed on Oct. 27, 2017, the contents of which are incorporated herein by reference in its entirety.

FIELD OF THE DISCLOSURE

This disclosure relates to holsters for firearms, and more particularly to an adjustable holster for a firearm.

BACKGROUND

A firearm, such as a pistol or revolver, is commonly carried using a holster. Holsters are often secured to a person's body, for example at the waist, leg or back, to provide ready access to the handgun placed therein. Once secured, a person can holster the firearm into the holster and draw the firearm from the holster using one hand. Moreover, holsters can enable different carry options, such as open carry or concealed carry, depending on the location and configuration of the holster. Holsters also protect the firearm from damage and inadvertent discharge by retaining it in the holster. In some instances, the holster may include a retention mechanism, such as a strap, to prevent the firearm from being inadvertently removed or otherwise dislodged from the holster while it is being carried.

SUMMARY

One example embodiment of the present disclosure provides a holster including a body including a cavity to receive a firearm and a first removable clip pivotably attached to the body via a first hinge pin. In some cases, the holster further includes a second removable clip pivotally attached to the body via a second hinge pin, a first hinge plate attached to a first side of the body and configured to receive the first hinge pin, and a second hinge plate attached to a second side of the body and configured to receive the second hinge pin. In some other cases, the first removable clip and the second removable clip rotate about the first hinge pin and the second hinge pin, respectively, in response to a movement of a user. In yet other cases, the holster is at least one of an inside-waist-band holster and an outside-waste-band holster based on a configuration of the first removable clip and the second removable clip. In some cases, the first removable clip and the second removable clip are configured to receive one of a belt and a waistband. In other cases, the holster is configured as either a right-hand holster or a left-hand holster based on a direction in which the first removable clip and the second removable clip are positioned relative to the body. In some such cases, the first removable clip and the second removable clip are interchangeable with one another to configure the holster as either a right-hand holster or a left-hand holster. In some cases, the body is positioned at an angle relative to a vertical axis of the holster, and the first hinge pin is parallel to the vertical axis of the holster. In some other cases, the first removable clip is positioned parallel to the second removable clip about a vertical axis of the holster. In other cases, the first removable clip further includes at least one snap, the at least one snap comprising a curved member having an opening to allow the snap to be pressed onto a hinge pin disposed in the body, and configured to be attached to the body such that the opening faces in a direction away from the body as the holster is worn by a person. In some cases, the holster further includes at least one retention member disposed within the body. In some such cases, the holster further includes an insert within the retention member, the insert to adjust a force applied by the retention member to the firearm. In other cases, the first removable clip is configured to snap onto the first hinge pin. In some cases, the first and second removable clips are configured to receive a belt and a waistband.

Another example embodiment of the present disclosure provides a holster kit, the kit including a combination of a body including a cavity to receive a firearm, the body further comprising a first hinge plate connected to a first side of the body and a second hinge plate connected to a second side of the body, a first set of removable clips configured to receive a belt, the first set of removable clips comprising a first removable clip configured to pivotally attach to the first hinge plate and the second hinge plate, a second removable clip configured to pivotally attach to the first hinge plate and the second hinge plate, and a second set of removable clips configured to receive a waistband, the second set of removable clips comprising a third removable clip configured to pivotally attach to the first hinge plate and the second hinge plate and a forth removable clip configured to pivotally attach to the first hinge plate and the second hinge plate. In some instances, the holster is configured as at least one of an inside-waist-band holster and an outside-waste-band holster based on whether the first set of removable clips and the second set of removable clips are attached to the body. In some other instances, the holster is configured as either a right-hand holster or a left-hand holster based on a direction in which one of the first set of removable clips and the second set of removable clips are attached relative to the body. In yet other instances, individual clips of at least one of the first set of removable clips and the second set of removable clips are interchangeable to configure the body as either a right-hand holster or a left-hand holster.

Another example embodiment of the present disclosure provides a holster including a body having a cavity to receive a firearm and further having a first hinge plate attached to a first end of the body, the first hinge plate including a first hinge pin, a second hinge plate attached to a second end of the body that includes a second hinge pin, a first removable clip to be pivotally attached to one of the first hinge pin and the second hinge pin, a second removable clip pivotally attached to the first hinge pin or the second hinge pin that has not received the first removable clip, wherein the body is positioned at an angle relative to an axis of the holster such that the body is not parallel to the first and second hinge pins.

Another example embodiment of the present disclosure provides a holster assembly that includes a holster body defining a cavity configured to receive a portion of a firearm and a clip hingedly attached to the holster body.

In some embodiments, the clip is a first clip and the holster assembly further includes a first hinge leaf extending from a front-end portion of the holster body, a first hinge pin attached to the first hinge leaf, wherein the first clip is attached to the first hinge pin, a second hinge leaf attached to and extending from a rear-end portion of the holster body, a second hinge pin attached to the second hinge leaf, and a second clip hingedly attached to the second hinge pin.

In some embodiments, the first clip is rotatably attached to the first hinge pin and the second clip is rotabably attached to the second hinge pin.

In some embodiments, the first clip is removably attached to the first hinge pin and the second clip is removably attached to the second hinge pin.

In some embodiments, the holster assembly includes a first hinge knuckle on the first hinge leaf, the first hinge pin extending through the first hinge knuckle and a second hinge knuckle on the second hinge leaf, where the second hinge pin extends through the second hinge knuckle. A first clip knuckle is on the first clip, the first clip knuckle defining a first pin opening receiving the first hinge pin therethrough. A second clip knuckle is on the second clip, the second clip knuckle defining a second pin opening receiving the second hinge pin therethrough. For example, the first clip knuckle defines a slot along the first pin opening, the slot constructed for a snap fit with the first hinge pin. Similarly, the second clip knuckle defines a slot along the second pin opening, the slot constructed for a snap fit with the second hinge pin.

In some embodiments, reversing a position of the first clip and the second clip converts the holster assembly between an inside-waist-band holster and an outside-waste-band holster.

In some embodiments, reversing a position of the first clip and the second clip converts the holster assembly between a right-hand holster and a left-hand holster.

In some embodiments, the first clip is interchangeable with the second clip to configure the holster as either a right-hand holster or a left-hand holster.

In some embodiments, when the holster assembly is attached to a belt extending horizontally, the holster body is canted forward relative to a vertical axis, and the first hinge pin extends generally parallel to the vertical axis.

In some embodiments, when the holster assembly is attached to a belt extending horizontally, the cavity defines a draw axis that is canted forward relative to a vertical axis, and the first hinge pin extends generally parallel to the draw axis.

In some embodiments, the holster body includes at least one retention member. For example, the retention member includes a protrusion on an inside of the holster body, where the protrusion extends into the cavity to engage a firearm disposed therein. In another example, the retention member includes an insert disposed in the holster body and a fastener advanceable into the insert to adjust a position of the protrusion.

Another example embodiment of the present disclosure provides a holster body that defines a cavity sized and shaped to receive a portion of a handgun with a barrel of the handgun extending downward into the cavity. The holster body has a front portion, a rear portion opposite the front portion, a first panel extending between the front portion and the rear portion, and a second side panel spaced from and opposite the first side panel. When the handgun is installed in the holster body, a top of the barrel extends along the front portion of the holster body. A belt clip is configured to hingedly attach along the front portion of the holster body.

In some embodiments, the belt clip is removably attachable to the holster body.

In some embodiments, the holster assembly further includes a hinge leaf extending from the front portion of the holster body where the hinge leaf includes a hinge knuckle defining a pin opening, a clip knuckle on the belt clip and defining a pin opening constructed to align with the pin opening of the hinge knuckle when the belt clip is attached to the holster body. A hinge pin extends at least partially through the pin opening of the hinge knuckle and the pin opening of the clip knuckle when the belt clip is attached to the holster body.

In some embodiments, the clip knuckle defines a slot along the pin opening, where the slot is configured to receive the hinge pin therethrough and sized for a snap fit to the hinge pin.

In some embodiments, the belt clip has a clip body defining a passageway therethrough, and the belt clip has a clip leaf extending between the clip body and the clip knuckle.

In some embodiments, the cavity defines a draw axis and the hinge pin extends generally parallel to the draw axis.

In some embodiments, the draw axis is generally parallel to a vertical axis when the holster assembly is attached to a belt extending horizontally.

In some embodiments, the holster body defines a draw axis defining an angle from 5° to 30° with respect to a vertical axis when the holster assembly is attached to a belt extending horizontally, and wherein the hinge pin extends parallel to the vertical axis.

Another example embodiment of the present disclosure provides a holster kit that includes a holster body defining a cavity to receive a portion of a firearm and a first set of removable clips. The holster body includes a first hinge leaf extending from a front end of the holster body and a second hinge leaf connected to a rear end of the holster body. The first set of removable clips includes a first removable clip configured to pivotably attach to either of the first hinge leaf and the second hinge leaf, and a second removable clip configured to pivotably attach to either of the first hinge leaf and the second hinge leaf. Each removable clip defines a passageway configured to receive a belt therethrough.

In some embodiments, the kit also includes a second set of removable clips each defining a passageway configured to receive a waistband therein. The second set of removable clips includes a third removable clip configured to pivotably attach to either of the first hinge leaf and the second hinge leaf, and a forth removable clip configured to pivotably attach to either of the first hinge leaf and the second hinge leaf.

In some embodiments, the holster assembly can be configured as an inside-the-waist-band holster or an outside-the-waistband holster based on whether the first set of removable clips or the second set of removable clips is attached to the holster body.

In some embodiments, the holster assembly can be reconfigured between a right-hand holster and a left-hand holster by reversing a position of the first removable clip and the second removable clip when the first set of removable clips are attached to the holster body.

In some embodiments, individual clips of first set of removable clips and/or the second set of removable clips are interchangeable to configure the holster body as either a right-hand holster or a left-hand holster.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1A:
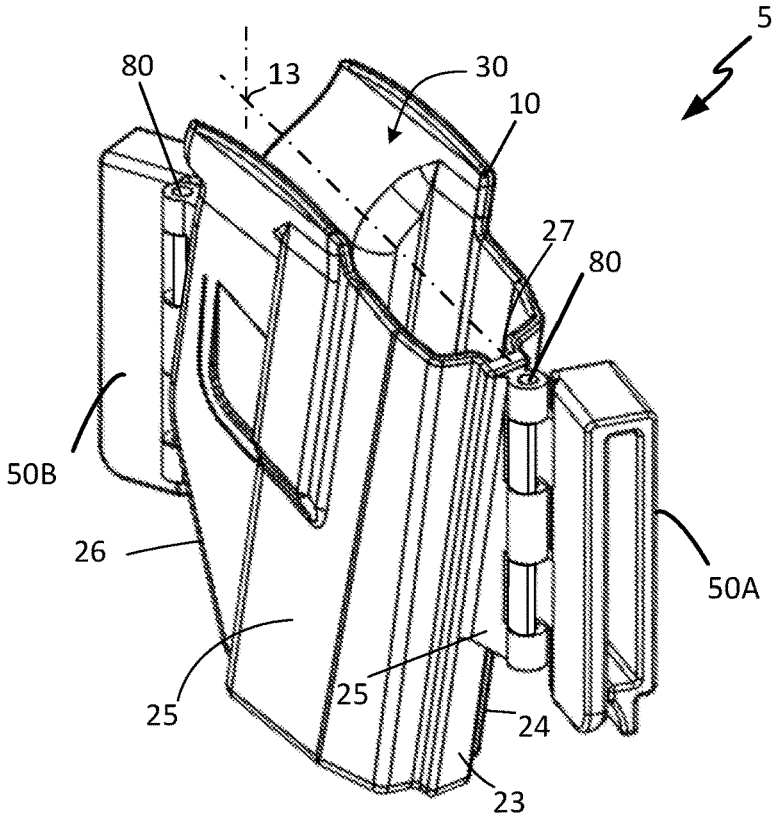
FIG. 1A is a top and front perspective view of an inside-the-waistband holster assembly configured for left-hand draw, in accordance with an embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing. Numerous variations, configurations, and other embodiments will be apparent from the following detailed discussion.

DETAILED DESCRIPTION

Assemblies and components of a firearm holster assembly are disclosed. In accordance with some embodiments, a holster assembly includes a body defining a cavity to receive a firearm, such as a pistol or revolver. The holster assembly also includes a first removable clip hingedly attached along the front-end portion of the holster body. Optionally, the holster assembly also includes a second removable clip that is hingedly attached along the rear-end portion of the holster body. The clip(s) may be removable and can be attached using a hinge leaf and hinge pin, for example. The holster assemblies of the present disclosure are configured to conform to the wearer's body and enable reconfiguration without the need to use tools. For example, some embodiments of the holster assembly can be reversibly configured for right-hand or left-hand draw without the use of tools, such as by reversing the position of the removable first and second clips. In some embodiments, the first and second clips are mirror images of each other. By selecting a clip configuration and appropriately assembling the clip(s) to the holster body, holster assemblies of the present disclosure can be reversibly configured for inside-the-waist-band or an outside-the-waste-band use, a canted or non-canted orientation, and/or for right-hand or left-hand draw. Numerous embodiments and variations will be apparent in light of the present disclosure.

General Overview

Firearms, such as handguns and revolvers, are often carried in a holster worn on the user's body. The holster protects the firearm from damage and can prevent inadvertent discharge while the firearm is holstered. A person may choose from many different locations to carry a holstered firearm. In general, holsters are designed to be worn against a person's body, such as against the back, hip, leg, or abdomen.

Holsters can be manufactured from a variety of materials, including leather, nylon, fabric, foam rubber, and molded plastics, to name a few examples. In some cases, the holster is shaped to accept a particular firearm and therefore can be made of stiff or rigid materials that hold a specific shape. Such materials, however, can be uncomfortable, such as when the holster contacts the wearer's body. The rigid nature of the holster material may also prevent the holster assembly from accommodating different body types because the assembly does not conform to the wearer's body. Thus, many holsters have a one-size-fits-all design regardless of the size and shape of the person using it. In addition, a holster can also cause discomfort as a person walks, runs, sits, or bends down, because it provides only limited flexibility, and thus cannot adjust to a person's moving body.

Firearm holsters are commonly made in two primary configurations, both of which are intended to be worn along a person's waist and secured using a belt. An inside-the-waistband (IWB) holster is worn so that the firearm can be securely carried inside the waistband of a person's pants. Although the holster is inside of the pants, for example, belt clips may extend over the top of the waistband and connect to the belt, for example. IWB holsters are commonly used for concealed carry. In contrast, an outside-the-waistband (OWB) holster can be configured so that the holster body and firearm are on the outside surface of the pants. A belt may extend through belt clips and along a side panel of the holster, for example. Movements, such as bending, twisting, or sitting may cause a conventional rigid holster to protrude into a person's body thereby creating discomfort for the carrier. Such movements can also cause the holster to "print" on the wearer's clothing, therefore enabling others to see an outline of the holster and/or part of the firearm. In addition, changes in a person's body size (e.g., changes to a person's torso or waist) can also cause a previously comfortable rigid holster to impinge against a person's body causing discomfort.

Some existing holsters can be configured for right-hand or left-hand draw. Such reconfigurable or ambidextrous holsters, however, often require disassembly to be re-configured for a particular draw preference. Holster disassembly often can be time consuming and involve fasteners that require the use of a tool. In many instances, components removed during reconfiguration become lost or damaged.

Thus, and in accordance with an embodiment of the present disclosure, assemblies and components of a reconfigurable holster assembly are disclosed. As disclosed herein, the holster assembly can be configured for a person's draw preference (e.g., right-hand or left-hand draw) and/or manner of carry (e.g., inside-the-waistband (IWB) or outside-the-waistband (OWB)). Further, the holster body can have a canted or non-canted orientation. Further yet, the holster assembly can be configured for the person's preferred position on the body. For instance, a single clip can be used for appendix carry while multiple clips can be utilized for carrying the firearm against a person's lower back or hip. The holster assemblies, in some cases, can be provided in the form a kit, from which the assembly can be assembled in different configurations, depending on a given application.

In one embodiment, the holster assembly includes a body that defines a cavity to receive a firearm. The body can be made from any suitable material, including polymeric materials for injection molding manufacturing processes. In some embodiments, the body, or portions thereof, can be overmolded with a thermoplastic elastomer. This can provide for a more comfortable or aesthetically pleasing product. The body, in some examples, includes a first hinge leaf connected to a front end of the body and a second hinge leaf connected to an opposite rear end of the body, where the front portion of the holster body generally extends along the top of the firearm barrel when the firearm is holstered. In some cases, the body can be a unitary body with integrally formed first and second hinge leaves. For example, the holster body and hinge leaves may be injection molded in a common mold. In some embodiments, the holster body can be formed to accept a mounting rail on the firearm, lights, optics, or other accessories attached to the firearm, as will be appreciated.

The holster assembly can include a hinge pin positioned along the front and/or rear portion of the holster body for attaching front and rear clips. For example, the holster body includes first and second hinge leaves that extend laterally from the holster body and include one or more hinge knuckles and the hinge pin for attaching a removable clip. The hinge pin can be formed integrally with the hinge leaves or can be a separate component. The clip(s) can include one or more hinge knuckle that attaches to and rotates about the hinge pin. In some embodiments, the clip knuckles are constructed for a snap fit with the hinge pin. As such the clips can be removed and installed without the need for tools.

The holster body, in some cases, can be canted or otherwise positioned at an angle (e.g., 10-30 degrees) relative to a vertical axis of the holster. For example, the cavity in the holster body can extend along a draw axis that defines an angle of 10-30° with the vertical axis. In some embodiments, the hinge leaves can extend horizontally from the holster body, whether canted or straight. In some such cases, the first hinge leaf and the second hinge leaf are attached to and extend horizontally from the holster body so that the hinge knuckle(s) and hinge pin are generally parallel to the vertical axis. In another example, each clip includes a hinge leaf that is canted with respect to the clip body. In such embodiments, the canted clips provide a canted orientation to the holster body when attached. In other cases, the body has a vertical or non-canted configuration so that the barrel of the holstered firearm is generally parallel with a vertical axis. A canted or non-canted clip can be attached to the holster body, resulting in a canted or non-canted orientation of the holster body when attached to a belt. For example, each clip has a clip leaf that extends from the clip body at an angle with respect to the central axis of the clip body. Depending on whether the holster body is canted with respect to the hinge leaves, the canted clips may result in either a canted or non-canted orientation.

In some embodiments, the holster body can include one or more retention members to secure or otherwise maintain the firearm within the holster. In one example, the retention member is a protrusion along an inside surface of the holster body that provides friction or interference with the holstered firearm. In another example, the retention member is adjustable fastener extending through the holster body, where the fastener can be adjusted to increase or decrease the size of the cavity, thereby adjusting the frictional force on the holstered firearm.

The disclosed holster assemblies can conform to a person's body when worn on a belt and/or waistband. The removable clip(s), in some embodiments, can snap onto and rotate about the hinge pin so that the holster assembly conforms to the person's body in response to movement, such as walking, bending, or twisting. The removable clips, in some cases, can include one or more clip knuckles that are configured to snap onto a hinge pin. Such knuckles enable the clips to be quickly and easily detached or otherwise removed from hinge pins without necessitating further disassembly of the holster assembly.

The removable clips, in some cases, can be interchangeable with one another to configure the holster for either right-hand or a left-hand draw, and/or either inside-the-waistband or outside-the-waistband holster assembly. For example, the holster assembly can include a set of clips configured to attach to a belt worn by the user, and another set of clips configured to engage a waistband of a person's clothing. Selecting a different clip and/or reversing the position of clips can convert the holster assembly between various configurations, as will be appreciated. Numerous holster configurations will be apparent in light of the present disclosure.

Note that while generally referred to herein as a clip for consistency and ease of understanding the present disclosure, the clips of the disclosed holster assemblies are not limited to that specific terminology and alternatively can be referred to, for example, as a waistband clip, a belt clip, or other terms. As will be further appreciated, the particular configuration (e.g., materials, dimensions, etc.) of a holster and its components configured as described herein may be varied, for example, depending on whether the target application or end-use is military, tactical, or civilian in nature. Numerous configurations will be apparent in light of this disclosure.

Also, as discussed herein, terms referencing direction, such as upward, downward, vertical, horizontal, left, right, front, back, etc., are used for convenience to describe embodiments of a holster assembly oriented as traditionally worn on a belt extending in a horizontal direction around one's waist. Embodiments of the present disclosure are not limited by these directional references or holster position and it is contemplated that the holster assemblies and its components could be used in any orientation.

Example Structure: Inside-the-Waistband Holster Assembly

Figure 1B:
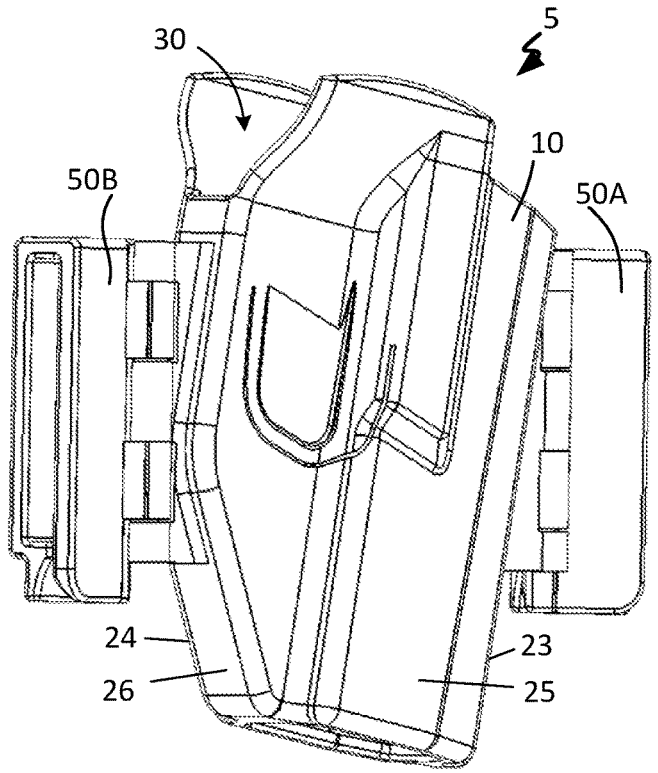
FIG. 1B is a side and rear perspective view of the inside-the-waistband holster assembly of FIG. 1A.
Figure 1C:
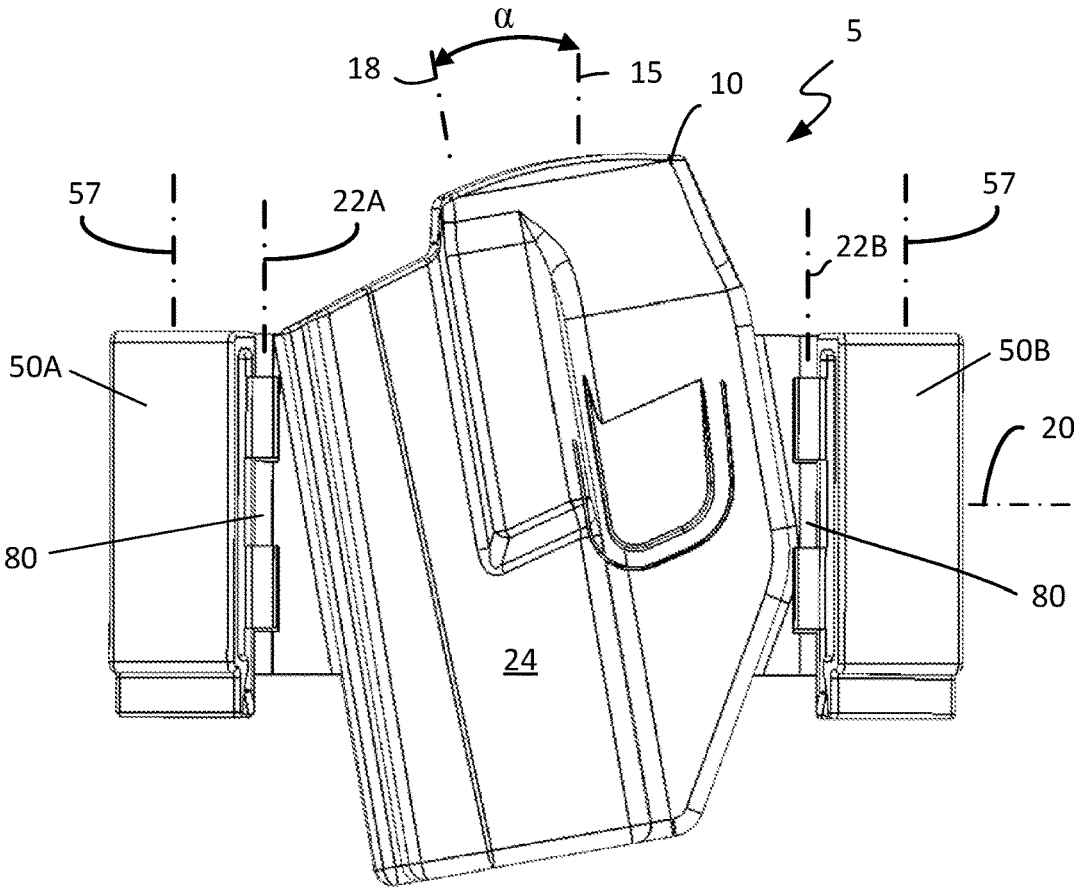
FIG. 1C is a side view of the inside-the-waistband holster assembly of FIG. 1A.
Figure 1D:
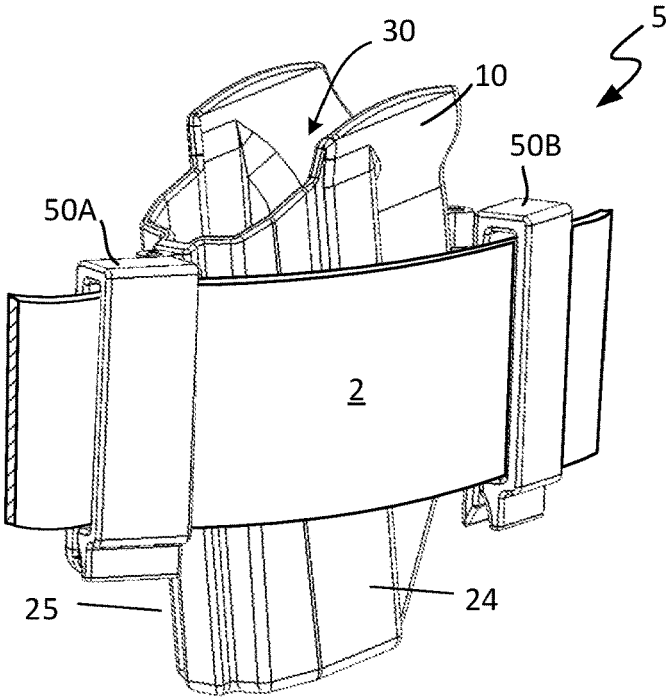
FIG. 1D is a front and side perspective view of the inside-the-waistband holster assembly of FIG. 1A shown attached to a belt that extends through the clip passageways and along the outside panel of the holster body, in accordance with an embodiment of the present disclosure.

FIG. 1A is a front perspective view of a holster assembly 5 configured as an inside-the-waistband (IWB) holster for left-hand draw, in accordance with an embodiment of the present disclosure. FIG. 1B is a rear perspective view of the holster assembly 5 of FIG. 1A. FIG. 1C is a side elevational view of the holster assembly 5 of FIG. 1A. FIG. 1D shows an example of the holster assembly 5 installed on a belt 2.

In the embodiment shown in FIGS. 1A-1D, the holster assembly 5 includes a holster body 10 with a first clip 50A and second clip 50B (collectively clips 50) hingedly attached to the holster body 10. The holster body 10 has a front portion 23, a first side panel 24, a second side panel 25 spaced from and opposite the first side panel 24, and a rear portion 26 opposite of the front portion 23. The holster body 10 defines a cavity 30 configured to receive part of a firearm, such as the slide, barrel, and trigger guard of a semiautomatic pistol. In general, the holster body 10 is constructed so that the firearm's barrel extends downward into the cavity 30, the trigger is disposed between the first and second panels 24, 25, and the grip is positioned outside of the holster body and extends in a rearward direction. In some embodiments, the cavity 30 includes a channel 27 centrally located along the front portion 23 and configured to slidingly receive a sight on top of the barrel or slide of a firearm to be holstered. The holster body 10 may be symmetrical about a medial plane 13 extending through the front portion 13 and rear portion 26, although this is not required. In some embodiments, the holster body 10 is substantially symmetrical, except as needed to accommodate controls on one side of a firearm, for example. The medial plane 13 of the holster body 10 corresponds to a medial plane of the firearm to be holstered, in accordance with some embodiments. Accordingly, the holster body can be used interchangeably on one's right or left side of the body.

In some embodiments, the holster body 10 may be canted or otherwise pitched forward so that the barrel of the firearm extends at a downward and rearward angle relative to the vertical axis. For example, the holster body 10 has a draw axis 18 that defines an angle $\alpha$ relative to a primary or vertical axis 15 of the holster assembly 5, as shown in FIG. 1C. The draw axis 18 corresponds to, or is parallel to, the bore axis of the holstered firearm, in accordance with some embodiments. Angle $\alpha$ can be from zero to about 30° in some embodiments, including 0-10°, 10-20°, 10-30°, and 20-30°. A forward cant can facilitate drawing the firearm from the holster in a smooth and continuous motion that may be more comfortable to the user, such as when the holster assembly 5 is positioned against a person's lower back. A forward cant of holster body 10 may also be preferred for some users who wear the holster assembly 5 on the back of the hip (e.g., 4 o'clock position), since the draw motion may involve reaching backward to some extent to grasp the grip of the firearm, as will be appreciated. Although the holster body 10 is canted forward in some embodiments, the clips 50 extend generally parallel to the vertical axis 15 and extend away from the holster body 10 along a secondary or horizontal axis 20. As shown in FIG. 1C, the central axes 57 of clips 50, are parallel to the vertical axis 15. Note that when the holster assembly 10 has a position other than as shown in the figures, the vertical axis 15 may be referred to as the primary axis. Similarly, the horizontal axis may be referred to as the secondary axis and understood to extend perpendicularly to the primary axis.

In one embodiment, a first clip 50A is attached along the front portion 23 of the holster body 10 and a second clip 50B is attached along the rear portion 26 of the holster body 10. When attached, the clips 50 can pivot about a hinge pin 80 that may extend along a generally vertical axis relative to the holster body 10. For example, each clip 50 is hingedly attached to the holster body 10 and rotates about an axis of rotation 22 defined by a hinge pin 80, such as shown in FIG. 1C. For instance, each clip 50 may be able to rotate in relation to body through an angle of more than 30 degrees, more than 45 degrees or more than 90 degrees. In some embodiments, the holster body 10 and clips 50 form a hinge. The clips 50 can pivot relative to the holster body 10 to enable the holster assembly 5 to conform to the wearer's body. Such adaptability enables the holster assembly 5 to be worn comfortably by people of different body shapes and allows the holster to conform to the wearer during movement.

Clips 50A and 50B are configured to be removable. Clips 50A and 50B can also be configured to be interchangeable with one another so that the holster assembly 5 can be configured for either a right-hand or left-hand draw. In some embodiments, the clips 50 are configured as mirror images of one another. For instance, to assemble the holster assembly 5 to be worn inside the waistband for a left-hand draw, the holster body 10 can be oriented with the first panel 24 of the holster body 10 facing away from the person's body, such as shown in FIGS. 1A-1D. A belt 2 can be then passed through clips 50A and 50B and along the first panel 24 of the holster body 10. When worn in this fashion, the holster assembly 5 provides greater flexibility. To reconfigure the holster assembly 5 for right-hand draw, a user could swap the position of clips 50A, 50B.

FIG. 1D illustrates an example of holster assembly 5 worn in a customary fashion with a belt 2 extending through passageways 70 defined through clips 50A and 50B. The belt 2 also extends along an outside or first panel 24. In the configuration shown in FIG. 1D, the second panel 25 of the holster body 10 is configured to be positioned against a person's body (e.g., a lower back or hip).

To assemble the holster assembly 5, the removable clips 50 are installed onto the hinge pins 80, for instance by snapping clip knuckles 60 onto the hinge pins 80. Each clip 50 can be installed on either the front portion 23 or rear portion 26 of the holster body 10, in accordance with some embodiments. As such, clips 50 are interchangeable with one another, such as when clips 50A and 50B are mirror images of one another. The interchangeability of the clips 50 allows the holster assembly 5 to be configured as either a right-hand or left-hand holster. The clips 50 can be swapped and then re-installed on opposite ends of the holster body 10. As a result, the holster assembly 5 can be attached to a person's clothing so that the first panel 24 of the holster body 10 faces towards or away from the person's body as desired. Note that the axes of rotation 22 in some embodiments remain essentially vertical while the holster assembly configuration is changed from a right-hand draw to a left-hand draw (or vice versa).

In one example of removing a clip 50 from the holster assembly 5, a person can grasp the clip 50 using one hand and apply a torque to it while holding the holster body 10 with the other hand to dislodge or otherwise remove the clip 50 from hinge pin 80. As a result, each resilient clip 50 can be separated from the hinge pin 80 manually by pulling or pushing the clips away from the hinge pins 80 without the need for tools. In some cases, a twisting motion can help start the separation of the clip 50 from the hinge pin 80. The clips 50 can be reinstalled onto the holster body 10 by snapping or otherwise pressing the clip's hinge knuckles 60 onto hinge pins 80 on the holster body 80. In addition, the clips 50 can be attached to the hinge pins 80 so that the clips 50 are prevented from being inadvertently dislodged or otherwise disengaged from the hinge pins 80 when the clips 50 are rotated to a carrying position, such as when the clips 50 extend from the holster body 10 generally along median plane 13 as shown in FIGS. 1A-1D.

The clips can be manufactured from a variety of materials including, carbon steel, aluminum, composite materials, or polymeric materials, to name a few examples. Polymeric materials, in some embodiments, may include a combination of nylon fibers and polymer resin. For example, the material can maintain resiliency over a temperature range of −10 to 40° C. so that the clip 50 can be successfully attached to and separated from the hinge pin 80 without damaging the clip 50. The hinge pins 80 can be manufactured, for example, from materials such as carbon steel, stainless steel, polymeric materials, or composite materials, for example. The hinge pins can be any size diameter to receive the clips. In an example embodiment, the hinge pins are manufactured from carbon steel or stainless steel and have a diameter of 1/16, 1/8 or 1/4 inch and a length of 2, 3, or 4 inches. In some cases, the hinge pins 80 are removable from the hinge leaves 35 to allow for replacement of damaged pins. In other cases, the hinge pins 80 can be molded into or permanently attached to the holster body 10 so that the hinge pins 80 are not removable. The hinge pins 80, in some other cases, can include threads so that they can be screwed or otherwise fastened to the hinge leaves 35 or hinge knuckles 37.

Figure 2A:
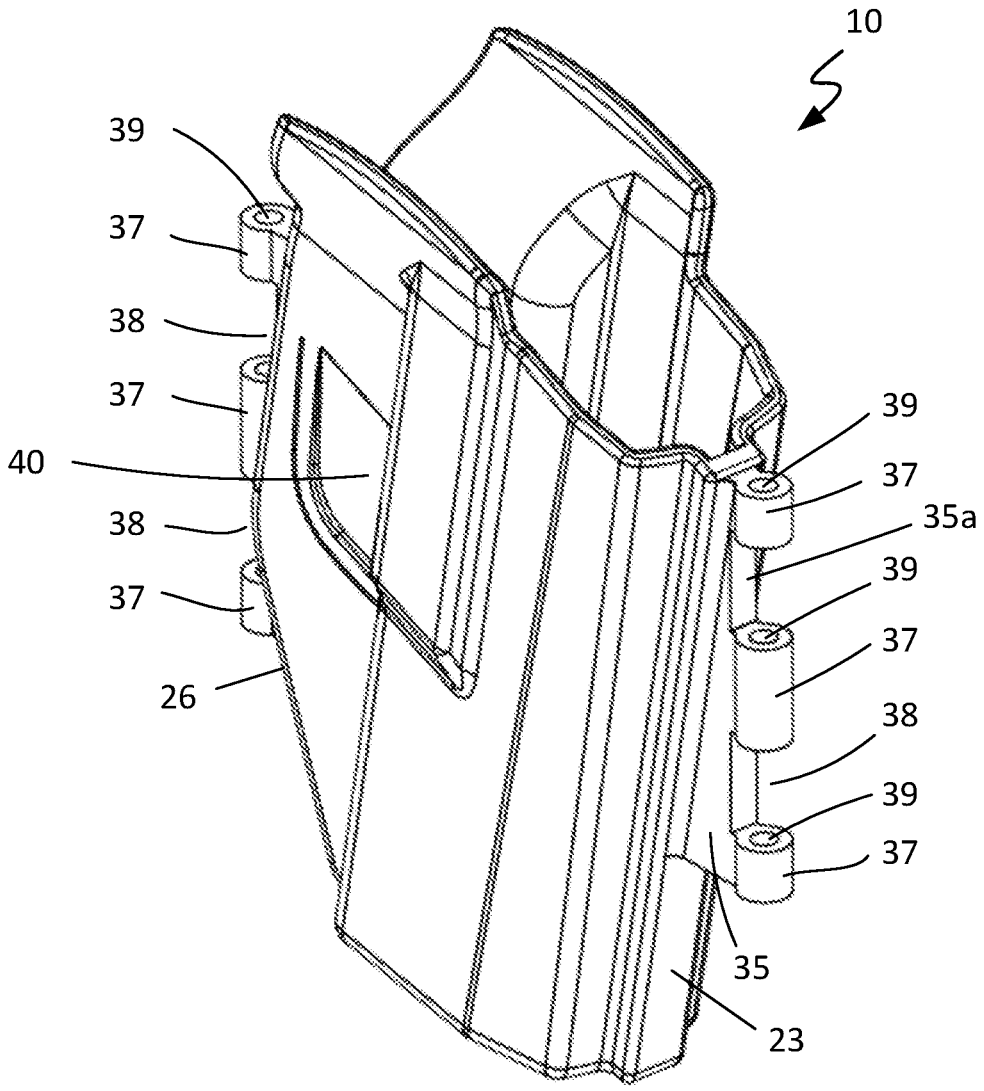
FIG. 2A is a front and side perspective view of the holster body of FIG. 1A showing the inside panel and a canted orientation with respect to the hinge leaves, in accordance with an embodiment of the present disclosure.
Figure 2B:
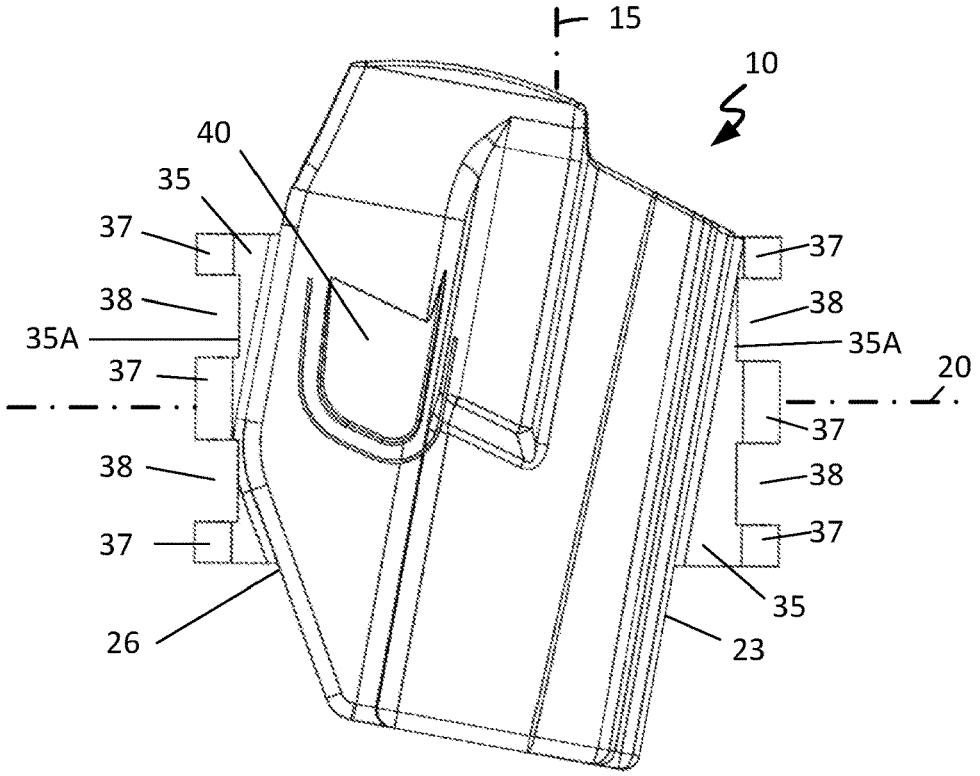
FIG. 2B is a side view of the holster body of FIG. 2A showing the inside panel of the holster body, in accordance with an embodiment of the present disclosure.
Figure 2C:
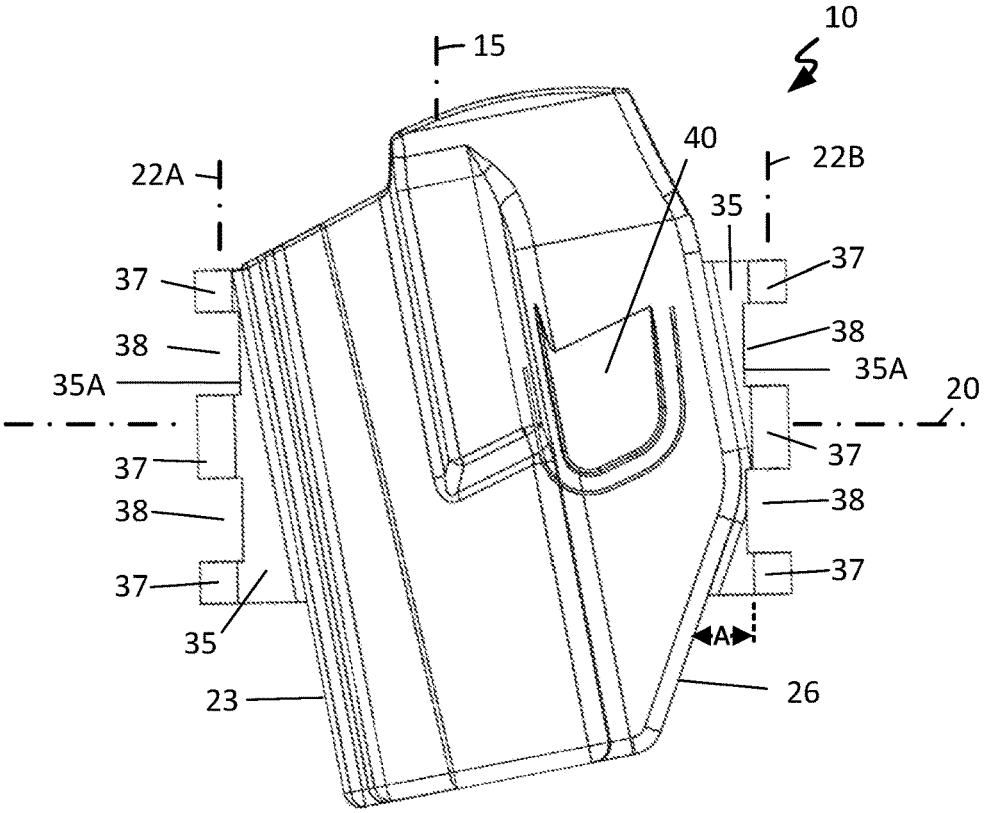
FIG. 2C is side view of the holster body of FIG. 2A showing the outside panel of the holster body, in accordance with an embodiment of the present disclosure.

FIGS. 2A-2C illustrate a holster body 10 in accordance with an embodiment of the present disclosure. FIG. 2A is a front perspective view and FIGS. 2B and 2C are a side views of the holster body 10 shown in FIG. 2A. The holster body 10 defines a cavity 30 sized and shaped to receive a portion of a firearm, such as the trigger guard and forward end portion of the barrel and slide of a semiautomatic handgun. In this example embodiment, the holster body 10 is canted forward about 20 degrees relative to the vertical axis 15.

Hinge leaves 35 connect to and extend horizontally along horizontal axis 20 from the front portion 23 and rear portion 26 of the holster body 10. For example, hinge leaves 35 extend in medial plane 13 (shown in FIG. 1) away from holster body 10 to a distal end 35*a* that includes one or more hinge knuckles 37 configured for a hinge pin 80 or equivalent. As shown in FIGS. 2B and 2C, for example, the distal end 35*a* of each hinge leaf 35 extends parallel to vertical axis 15. As such, the hinge knuckles 37 and hinge pin 80 are also parallel to the vertical axis 15. In general, the hinge leaves 35, together with clips 50 and hinge pins 80, form a hinge that allows the clips 50 to pivot relative to the holster body 10. In some other embodiments, the hinge leaves 35 can be separate components that are attached to the holster body 10. In other embodiments, the hinge leaves 35 can be integrally formed as part of the holster body 10. In some embodiments, the hinge knuckles 37 are aligned vertically on holster body 10 or are otherwise positioned so that clips 50 have a substantially vertical position when attached to the holster body 10.

The hinge leaves 35 provide an attachment location for clips 50. Hinge leaves 35 can also provide clearance between the clips 50 and the holster body 10 as clips 50 rotate about the hinge pin 80. In some embodiments, the hinge knuckles 37 include openings 39 to receive a hinge pin 80 therethrough. In other embodiments, clip knuckles 60 on the clip 50 have a protrusion or pin that is used in place of a hinge pin 80 with similar function. Each hinge leaf 35 can include one or more hinge knuckle 37. In some embodiments where hinge leaf 35 has a plurality of knuckles 37, the knuckles 37 are spaced apart vertically by gaps 38 configured to receive therebetween a corresponding clip knuckle 60 on the clip 50. In other embodiments having only one hinge knuckle 37, a portion of the distal end 35*a* of the hinge leaf 35 defines a gap 38 above or below the hinge knuckle 37 to accommodate the corresponding clip knuckle 60 of the clip 50.

As shown in FIG. 2C, the hinge plates 35 can position the hinge knuckles 37 a distance A from the holster body 10 along horizontal axis 20. The distance A, in some embodiments, can be the distance from one edge of the holster body 10 to the distal end 35*a* of the hinge leaf 35. Distance A, in some other embodiments, can be the distance from the edge of the holster body 10 to the axis 22 of rotation, or other suitable reference point. In some embodiments, it may be desirable for the hinge knuckles 37 to be located as close as possible to the holster body 10, such as to maintain a compact size of holster assembly 5. In an example embodiment, the hinge knuckles 37 are located a distance of ⅛, ¼ or ½ inch from the holster body 10. Numerous other configurations will be apparent in light of the present disclosure.

In some embodiments, the holster body 10 defines one or more retention member 40 for securing the firearm within the cavity 30. In one embodiment, the retention member 40 is a tab or protrusion that extends into the cavity 30 from first and/or second panel 24, 25. The protrusion engages the firearm when it is installed in the cavity 30. Each retention member 40 can be positioned within the cavity 30 to press against the firearm and increase frictional forces between the firearm and the holster body 10. Alternately, the retention member(s) 40 can be positioned to extend into the trigger guard when the firearm is installed in the cavity 30, thereby providing interference to releasably lock the firearm in the holster body 10. The friction and/or interference is useful to maintain the firearm firmly positioned within the holster body 10 while also allowing the user to draw the firearm when needed. The retention members 40 can be positioned parallel to one another along opposing first and second panels 24, 25. In some examples, the retention members 40 may include one or more raised surfaces to increase the contact between the firearm and holster body 10 when the firearm is holstered. When the firearm is installed into the holster body 10, it contacts the retention member(s) 40, causing them to deflect away from the cavity 30. As a result, the frictional forces increase between the firearm and the holster body 10 to prevent inadvertent removal of the holstered firearm. In yet other embodiments, the retention member 40 is a spring-loaded catch or the like that engages the holstered firearm. Numerous other retention configurations will be apparent in light of the present disclosure.

Figure 3A:
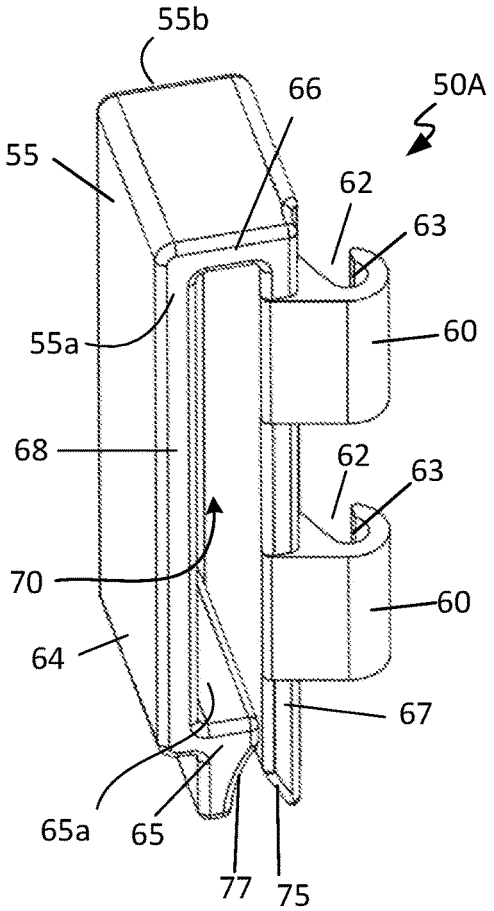
FIG. 3A is a rear-end perspective view of a first removable waistband clip shown in FIG. 1A, in accordance with an embodiment of the present disclosure.
Figure 3B:
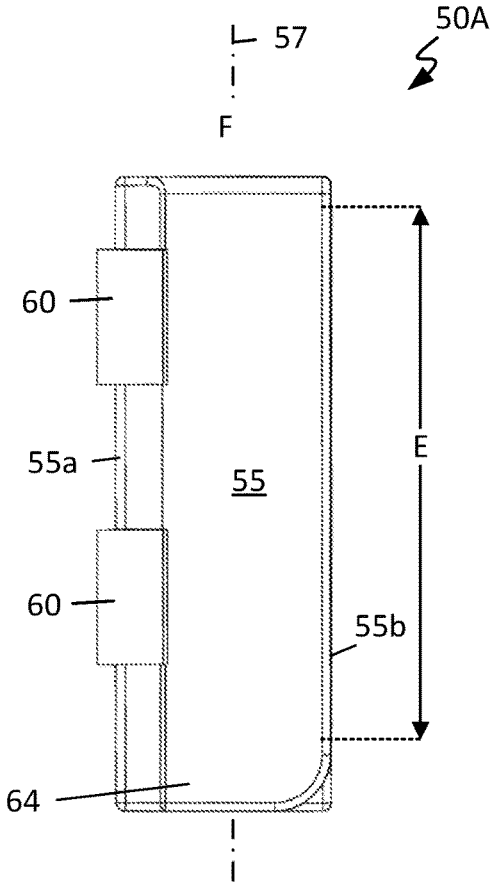
FIG. 3B is a side view of the first removable waistband clip shown in FIG. 3A, in accordance with an embodiment of the present disclosure.
Figure 3C:
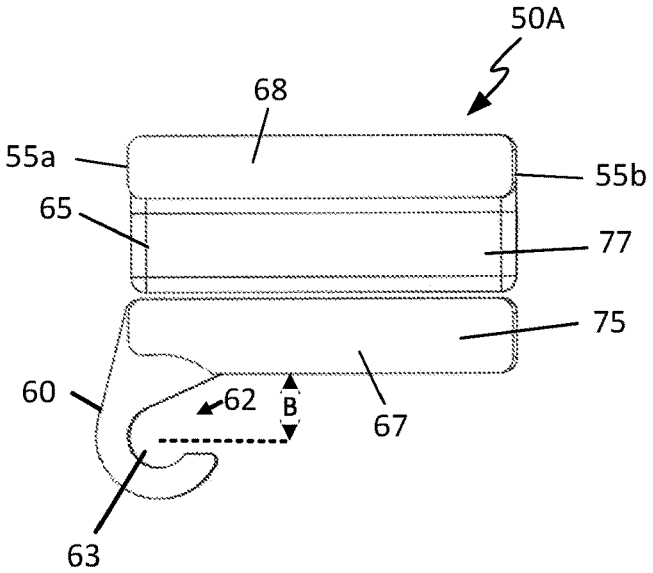
FIG. 3C is a bottom-end view of the first removable waistband clip shown in FIG. 3A, in accordance with an embodiment of the present disclosure.
Figure 4A:
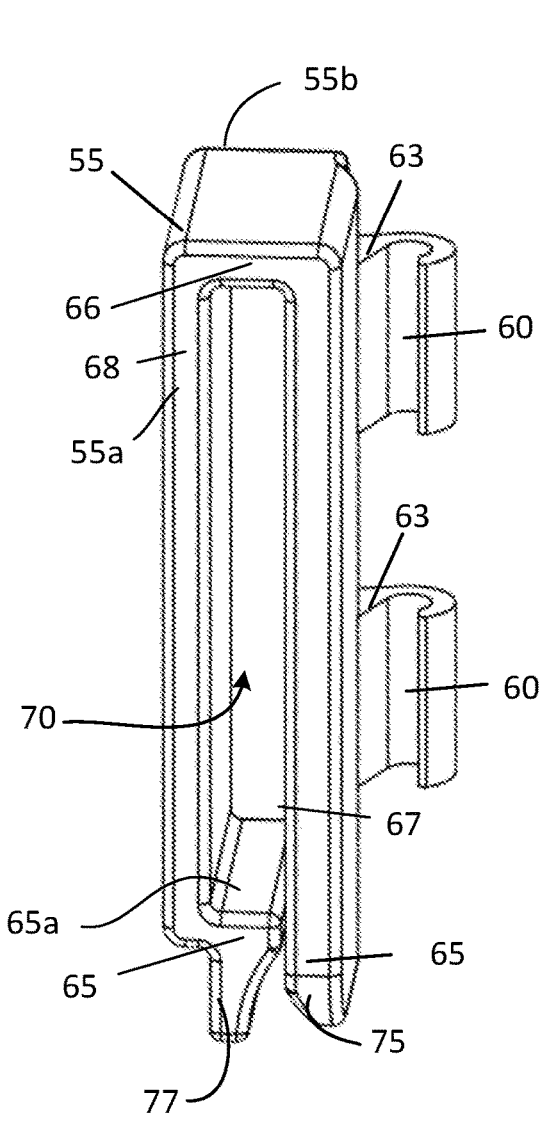
FIG. 4A is rear-end perspective view of a second removable waistband clip shown in FIG. 1B, in accordance with an embodiment of the present disclosure.
Figure 4B:
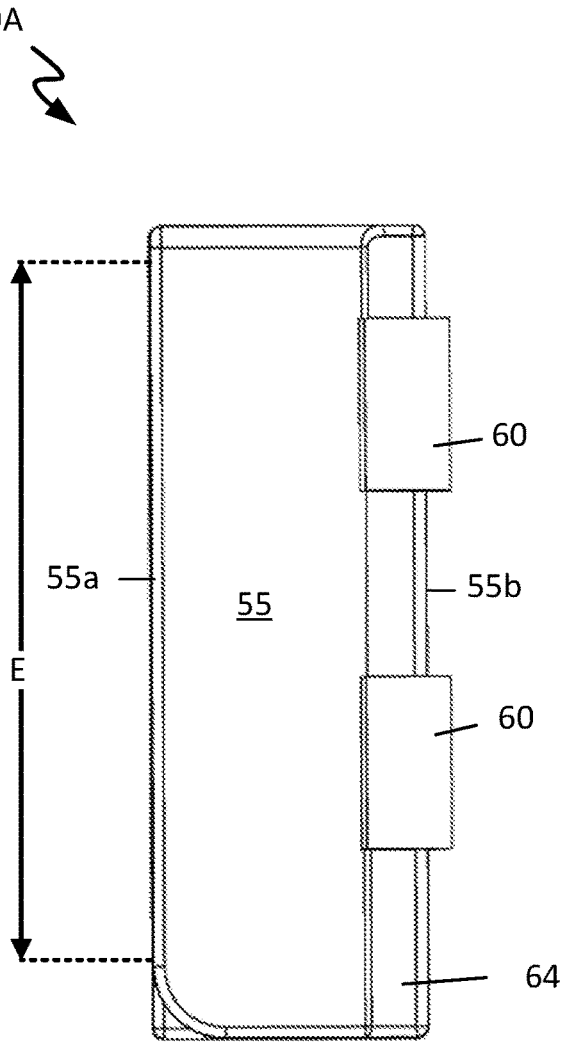
FIG. 4B is a side view of the second removable waistband clip of FIG. 4A.

Referring now to FIGS. 3A-3C and 4A-4B, clips 50B and 50A, respectively, are illustrated in accordance with some embodiments. FIG. 3A is a perspective view, FIG. 3B is a side view, and FIG. 3C is a bottom-end view of the first clip 50A. FIG. 4A is a perspective view and FIG. 4B is a side view of second clip 50B, which is a mirror image of first clip 50A shown in FIGS. 3A-3C. In the embodiments shown, the clips 50 include a clip body 55 defining a passageway 70 sized for passage of a belt or the like. The clip body 55 can include an inside wall 67, an outside wall 68, a top wall 69. One or more clip knuckles 60 are attached to the clip body 55, such as along a forward clip end 55*a* or rear clip end 55*b*. As viewed from the side (FIGS. 3B and 4B), the clip body 55 can have a generally rectangular shape extending along a vertical central axis 57. Other shapes are acceptable.

In some embodiments, the passageway 70 has a rectangular cross-sectional shape, consistent with the profile of many belts. For example, the passageway 70 is defined between a bottom wall 65, a top wall 66, an inside wall 67, and an outside wall 68 joined in a rectangular shape. The passageway 70 can be any size sufficient to allow the clip 50 to securely attach the holster body 10 onto a waistband or belt, as will be appreciated. In an example embodiment, the passageway 70 has a vertical dimension E from 0.5 to 2.0 inches.

In some embodiments, a lower end portion 64 of the clip body 55 is openable to provide an alternate ingress to the passageway 70. In embodiments of clip 50 that are openable, the clip body 55 can be separable between the bottom wall 65 and the inside wall 67 of the clip body 55, or other suitable location. For example, the bottom wall 65 is not continuous with the inside wall 67. By spreading apart the lower end portion 64 of the clip body 55, the user may insert a belt and/or waistband into the passageway 70. Since the clip 50 may be made of a flexible and resilient material, the clip 50 is biased to return towards its resting shape (shown) to capture or engage the clothing, belt, etc. In such embodiments, the bottom wall 65 can have a bottom inside floor 65*a* that defines a horizontal ledge to engage a belt 2 or act as a catch surface to engage a waistband positioned in the passageway 70. In some embodiments, the inside wall 67 and outside wall 68 have tapered ends 75, 77, respectively, to facilitate opening the clip body 55 and to facilitate ingress to passageway 70.

The clip 50 includes one or more clip knuckles 60 for attaching the clips 50 to the hinge pin 80 (shown e.g. in FIGS. 8A-8B) on the holster assembly 5. In some embodiments, each clip knuckle 60 defines a pin opening 63, where clip knuckle 60 and hinge knuckle 37 can be assembled together with hinge pin 80 to define a hinge. In some embodiments, such as shown in FIGS. 3A and 4A, clips 50 each include two clip knuckles 60 constructed as a hook or open knuckle. For example, the hinge knuckle 37 has a C-shape with an open slot 62 along pin opening 63, both sized to receive hinge pin 80 therethrough. Together with the hinge leaf 35, hinge knuckles 37, and hinge pin 80, clip 50 with clip knuckles 60 forms a separable hinge, also sometimes referred to as a take-apart hinge or lift-off hinge. In some embodiments, the slot 62 is sized slightly smaller than the diameter of hinge pin 80 so that the clip knuckle 60 can snap onto the hinge pin 80 (e.g., a snap fit). For example, the clip knuckle 60 is made of a sufficiently resilient material so that the slot 62 can expand in size as the hinge pin 80 is forced through the slot 62 into the pin opening 63 of the clip knuckle 60. In other embodiments, the slot 62, can be slightly larger than the radius of the hinge pin 80 to allow the pin 80 to be easily installed axially through pin openings 63 or through slot 62.

The clip knuckles 60, can be parallel to the central axis 57 of the clip 50 and also parallel with the vertical axis 15 when the clip 50 is attached to the holster body 10. As shown, the clip knuckles 60 are aligned and oriented so that the open slot 62 faces the same direction. In other embodiments, the slot 62 of adjacent clip knuckles 60 may open in different directions, for example, 180 degrees opposed to each other. Clip knuckles 60 may have different lengths but typically have the same inner diameter so that they can attach to a consistently dimensioned hinge pin 80. In some embodiments, each clip knuckle 60 may have a length ranging from 0.125 to 1.0 inch. As can be seen in FIG. 3C, the clip knuckle 60 can extend from the clip body 55 to allow the clips 50 to rotate freely without contacting the holster body 10. In some embodiments, the clip knuckle 60 extends away from clip body 55 along horizontal axis 20, away from inside wall 67 perpendicular to horizontal axis 20, or in a combination of both directions. As shown in FIG. 3C, for example, clip knuckles 60 connect to the inside wall 67 adjacent forward clip end 55*a* and extend away from the inside wall 67 so that the center of pin opening 63 is spaced from the inside wall 67 by a distance B and approximately aligned with forward clip end 55*a*; in the embodiment of FIGS. 4A-4B, the clip knuckle 60 similarly extends from the rear clip end 55*b*.

When the hinge pin 80 is installed, the clip knuckle 60 can extend between 180 to 250 degrees around the hinge pin 80, in accordance with some embodiments. In other embodiments, the clip knuckle 60 can extend 260, 280, or 300 degrees around the hinge pin 80 when installed therein. In yet other embodiments, the clip knuckle 60 substantially surround or completely surrounds the hinge pin 80, such as when a snap fit with the hinge pin is not utilized and hinge pin 80 is installed axially through the pin opening 63.

In accordance with some embodiments, the holster assembly 5 may utilize one or two clips 50 to attach the assembly 5 to a person's clothing. For instance, a single clip 50 can be attached to the holster assembly 5 for use with the holster worn inside-the-waistband, such as near a person's appendix. As a person moves, the clip 50 allows the holster to move and conform to a person's body. The movement of the holster assembly 5 may be enhanced as compared to assemblies having two clips 50 because the holster assembly can move through a larger range of motion when attached to a waistband using a single clip 50. The holster assembly with two clips 50 can be attached to either side of the body to configure the assembly as either a right-hand or left-hand holster assembly, for example.

Example Outside-Waist Band Holster Application

Figure 5:
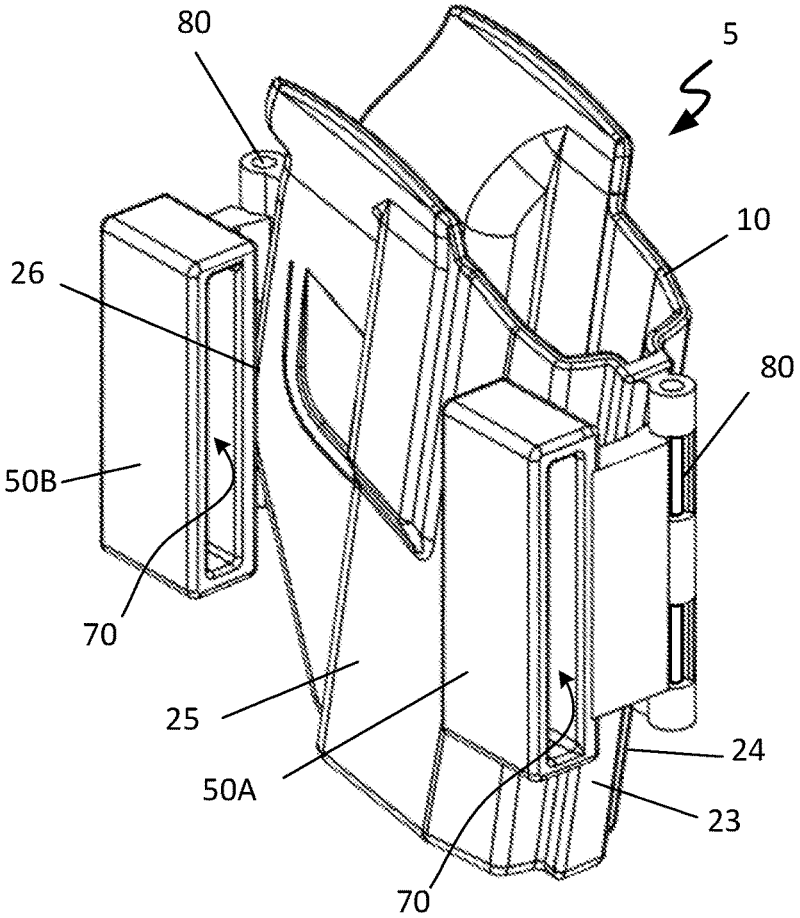
FIG. 5 is a perspective view of an outside-waistband holster assembly configured for left-hand draw, in accordance with an embodiment of the present disclosure.

FIG. 5 is a perspective view of a holster assembly 5 configured for outside-the-waistband (OWB) use and left-hand draw, in accordance with an embodiment of the present disclosure. Generally, an OWB holster is one that attaches to the wearer's belt or waistband on the outside of clothing. OWB holsters are commonly used in situations in which a person wants to openly carry a firearm or have access to the firearm without being encumbered by clothing. In an example embodiment, the holster assembly 5 configured for OWB use includes a holster body 10 and clips 50 hingedly attached along the front portion 23 and rear portion 26 using hinge pins 80. The holster body 10 and hinge pins 80 have been previously described herein. In some embodiments, clips 50 are positioned so that passageways 70 are aligned along the outside of the second panel 25. In such position, a belt 2 (shown in FIG. 1D) can pass through the passageways 70 and along the face of the second panel 25 when the holster assembly 5 is worn on the person's body. The holster body 10 can be oriented straight or canted, as discussed above.

Figure 6:
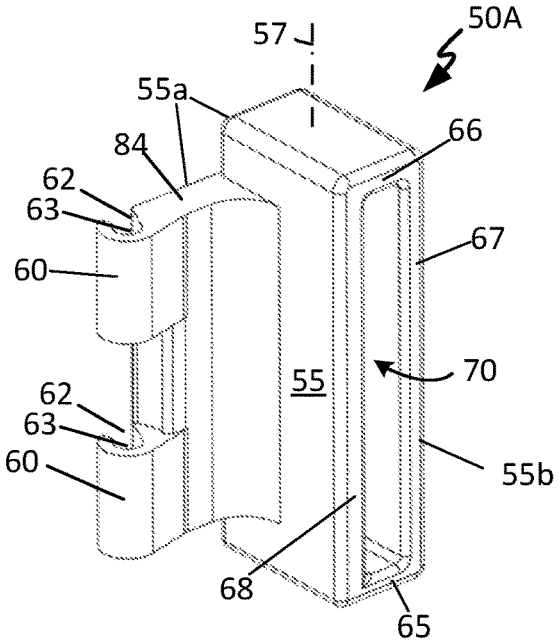
FIG. 6 is a rear-end perspective view of a first clip shown in FIG. 5, in accordance with an embodiment of the present disclosure.

FIG. 6 is a perspective view of a clip 50 configured in accordance with an embodiment of the present disclosure. Clip 50 has a clip body 55 defining passageway 70 defined between inside wall 67, outside wall 68, top wall 66, and bottom wall 65. In some embodiments, the passageway 70 is closed. In other embodiments, clip 50 can also be openable at the lower end portion 64 similar to as discussed above with reference to FIGS. 3A-3C and 4A-4B. In some embodiments, clips 50 can be identical. In other embodiments, clips 50 are symmetrical or mirror images of each other.

An arm or clip leaf 84 is attached to and extends away from the outer wall 68 of the clip body 55. The clip leaf 84 defines one or more clip knuckles 60, such as clip knuckles 60 defining an open slot 62 and pin opening 63 as discussed above. The clip knuckles 60 can also be constructed as a barrel or annulus with the pin opening 63 extending therethrough. In some embodiments, the clip leaf 84 is attached adjacent the forward clip end 55*a* and extends perpendicularly from the outside wall 68 to clip knuckles 60. In some such embodiments, the slot 62 is also positioned along the forward clip end 55*a*. When the clips 50 are installed, the clip leaf 84 spaces the clip 50 from the holster body 10 so that the clips 50 can be rotated sufficiently before contacting the holster body 10. For example, the clips 50 rotate through a range of at least 180° in one example embodiment.

When worn on a person's clothing, the clips 50 can be positioned so that a belt 2 passing though the passageways 70 is located between the holster body 10 and the person's body. As can be seen in FIG. 5, for example, the clips 50 can be installed so that the slot 62 opening faces outward and away from the front portion 23 and rear portion 26 of the holster body 10. In such position, the clips 50 are prevented from detaching from the holster body 10 since the hinge leaf 35 on the holster body 10 blocks the clip knuckle 60 from separating from the hinge pin 80.

Further Holster Configurations

Figure 7A:
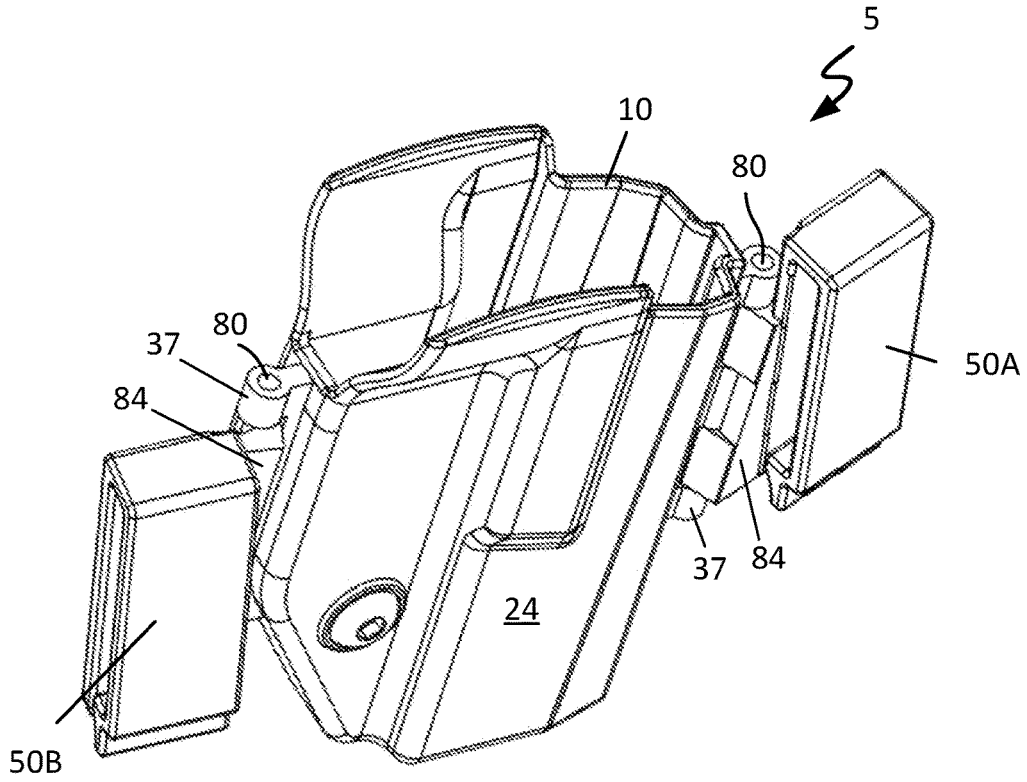
FIG. 7A is a top, rear, and side perspective view of an inside-the-waistband holster assembly configured for right-hand draw, in accordance with an embodiment of the present disclosure.
Figure 7B:
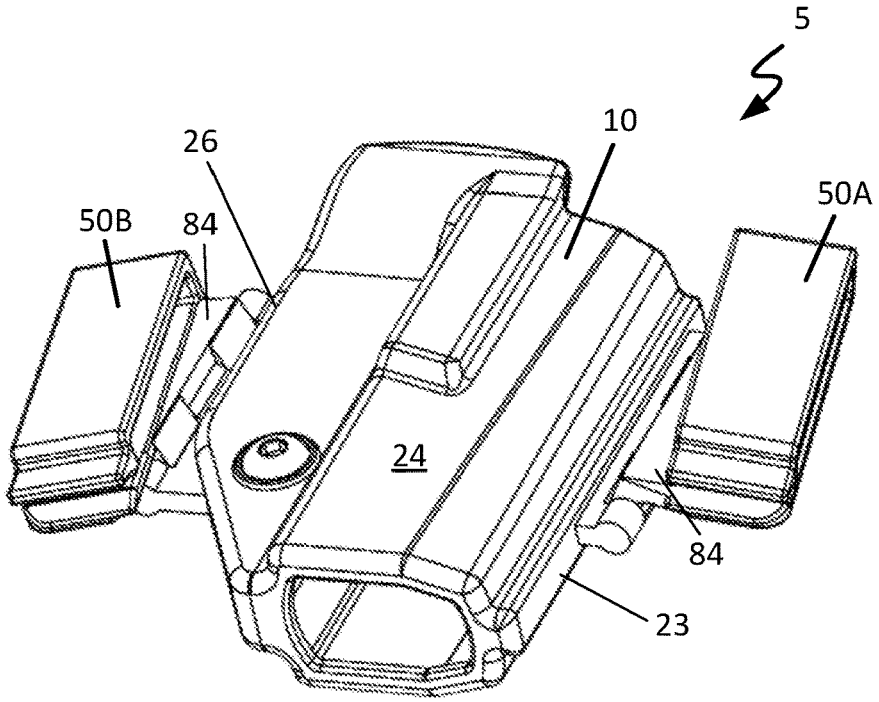
FIG. 7B is a bottom perspective view of the inside-waistband holster of FIG. 7A, in accordance with an embodiment of the present disclosure.
Figure 7C:
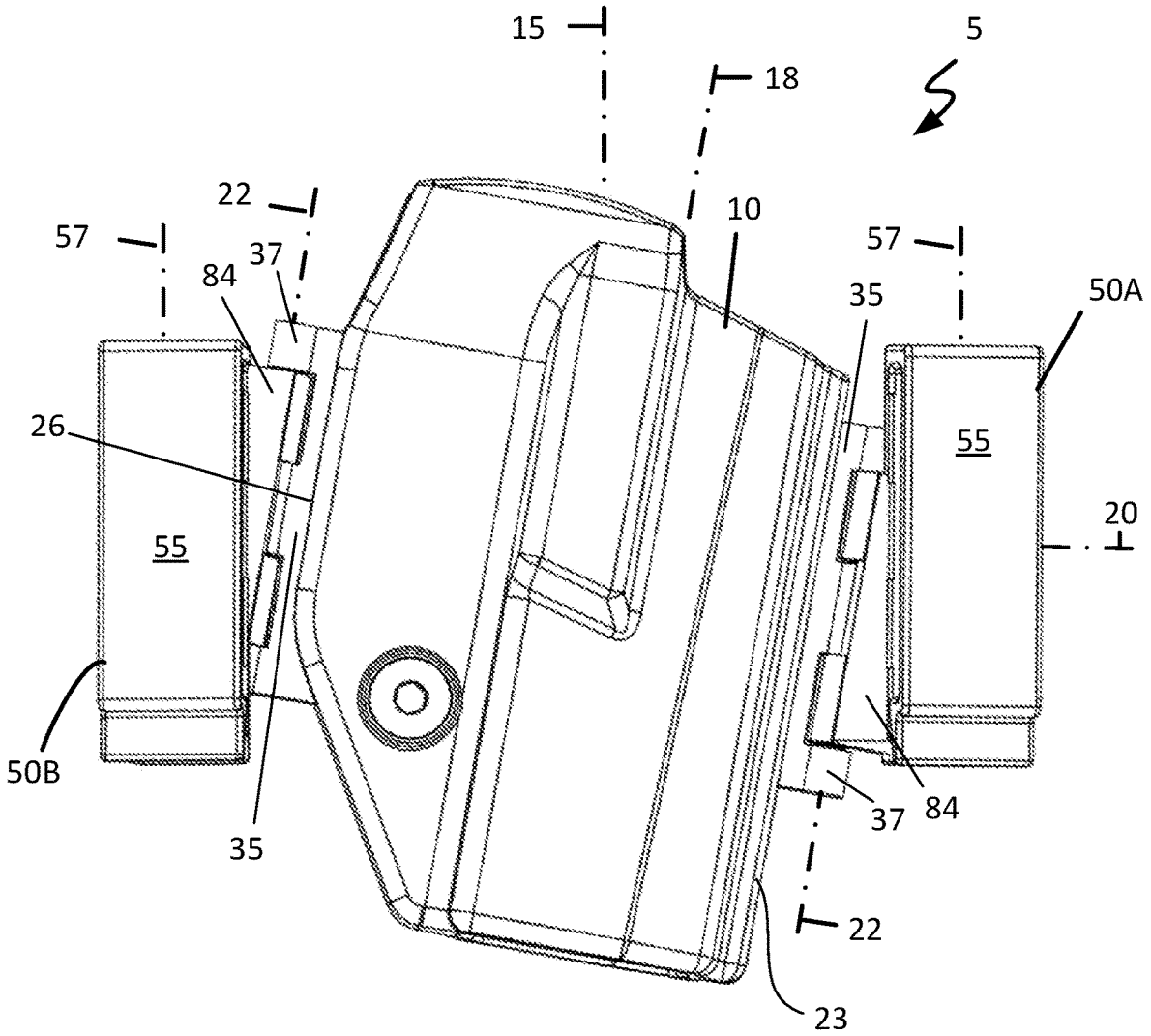
FIG. 7C is a side view of the inside-waistband holster of FIG. 7A showing the outside panel of the holster body, in accordance with an embodiment of the present disclosure.
Figure 7D:
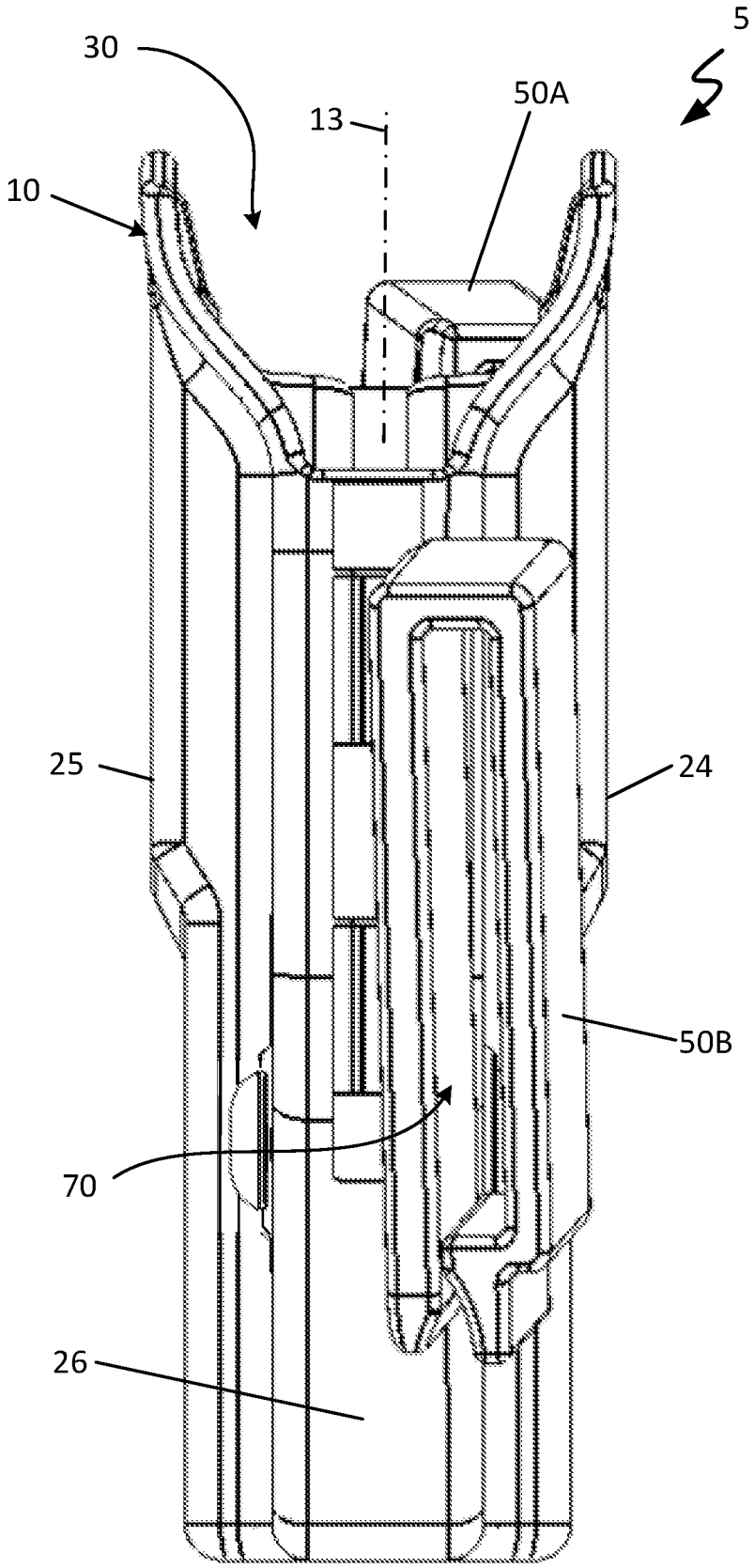
FIG. 7D is a rear view of the holster assembly of FIG. 7A, in accordance with an embodiment of the present disclosure.

FIGS. 7A-7D illustrate a holster assembly 5 configured for right-hand draw and inside-the-waistband use, in accordance with an embodiment of the present disclosure. By rotating the clips 50 somewhat about the hinge pin 80, this embodiment could also be used as an OWB, left-hand draw holster, as will be appreciated. FIG. 7A is a top and side perspective view, FIG. 7B is a bottom and side perspective view, FIG. 7C is a side view of the holster assembly 5, and FIG. 7D is a rear view of the holster assembly 5 as viewed along the medial plane 13. In one embodiment, the holster assembly 5 includes a holster body 10 that is not canted or is minimally canted. In other embodiments, the degree of cant is determined by the configuration of the clips 50. In the example embodiment of FIGS. 7A-7D, the holster body 10 is canted forward due to the configuration of clip leaves 84 on the removable first and second clips 50A and 50B. However, clips 50 as shown in FIG. 3A-3C, 4A-4B, or 6 could be used to provide a non-canted orientation since the clip leaves 84 extend horizontally from the clip body 55 rather than at an angle.

In the embodiment of FIGS. 7A-7D, hinge leaves 35 extend away from the front portion 23 and rear portion 26 in a direction perpendicular to the draw axis 18. For example, the front portion 23 and the rear portion 26 each defines a margin that is parallel to the draw axis 18. The hinge leaves 35 extend forward or rearward from the holster body so that the axes of rotation 22*a*, 22*b* through hinge knuckles 37 is parallel to the draw axis 18. That is, when the draw axis 18 is vertical, the hinge leaves 35 extend horizontally. The draw axis 18 may be canted or not canted with respect to the vertical axis 15 depending on the configuration of the clips 50 attached to the holster body 10.

The holster body 10 can be attached to a person's clothing in a canted or non-canted orientation by using different clip 50 configurations. Thus, the holster assembly 5 can be customized to fit a particular manner of draw using one or more varieties of clips 50. Clips 50 may be the same, different, or a mirror image of one another. Clips 50 exhibiting different cant angles, as determined by alignment of the clip knuckles 60, can provide for a canted or non-canted draw configuration.

The removable clips 50 allow the holster assembly 5 to be quickly and easily re-configured for either a right-handed or left-handed draw and either canted or non-canted orientation without requiring tools. To assemble the holster assembly 5, for example, the removable clips 50 are installed by snapping clips 50A and 50B onto the hinge pins 80. Clips 50A, 50B may be configured differently from one another to allow the holster body 10 to be canted or straight with respect to the vertical axis 15. Thus, to configure the holster assembly 5 as either a right-hand or a left-hand holster, a different set of clips can be used for each configuration. As previously described herein, the clips 50 (e.g., a first set of clips 50) can be separated from the hinge pins 80 manually by pulling or pushing the clips 50 away from the hinge pins 80, causing the clip knuckles 60 to release from the pins 80. Once removed, the clips 50 can be replaced with another, different set of clips 50 (e.g., a second set of clips 50). Thus, the holster configuration can be changed from a right-hand to a left-hand holster (or vice versa) depending on the configuration of the clips 50 installed. The holster body 10 also be changed from a canted orientation to a non-canted orientation by using clips that exhibit different angles between the central axis 57 of the clip 50 and the axis of the clip knuckles 60, in accordance with some embodiments.

As shown in FIG. 7C, the clips 50 may include a clip leaf 84 with clip knuckles 60 aligned along an axis of rotation 22. In some embodiments, the clip leaf 84 extends at an angle to the vertical central axis 57 of the clip body 55 so that the axis of rotation is not parallel to the vertical axis 15, but is generally parallel to the draw axis 18. Unlike some clips 50 that are interchangeable with one another, clips 50 in this embodiment are not identical and are not mirror images of one another. As a result, the holster assembly 5 can be configured with a canted orientation as shown when clips 50 having canted clip leaves 84 are attached. Note that for second clip 50B, the top edge of the clip leaf 84 is longer than the bottom edge (~0 length) and connects to the clip body 55 near its top surface. In contrast, the bottom edge of the clip leaf 84 of first clip 50A is longer than the top edge and connects near the bottom of the clip body 55. Since a person's belt or waistband extends through the clips 50 along a generally horizontal path, the central axis 57 of the clips 50 remains generally vertical. Thus, using various clip 50 configurations with the holster body 10 of this embodiment, the same holster body 10 can be configured to have a non-canted orientation by using clips 50 having non-canted clip leaves 84, or configured to have a canted orientation by using clips 50 having canted clip leaves 84.

FIG. 7D shows the holster assembly 5 as viewed looking at the rear portion 26 of the holster body 10 along the medial plane 13. The holster body 10 has a symmetrical shape. Clips 50A and 50B are positioned between the medial plane 13 and the first (outside) panel 24 of the holster body 10. In use as a IWB, right-hand draw holster, the first panel 24 would be positioned away from the user's body and the second panel 25 would contact the user's body. A belt 2 passing through the passageways 70 and along first panel 24 will generally follow the contour of the person's body. The hinged attachment of clips 50A and 50B facilitates holster assembly 5 conforming to the person's shape.

Figure 8A:
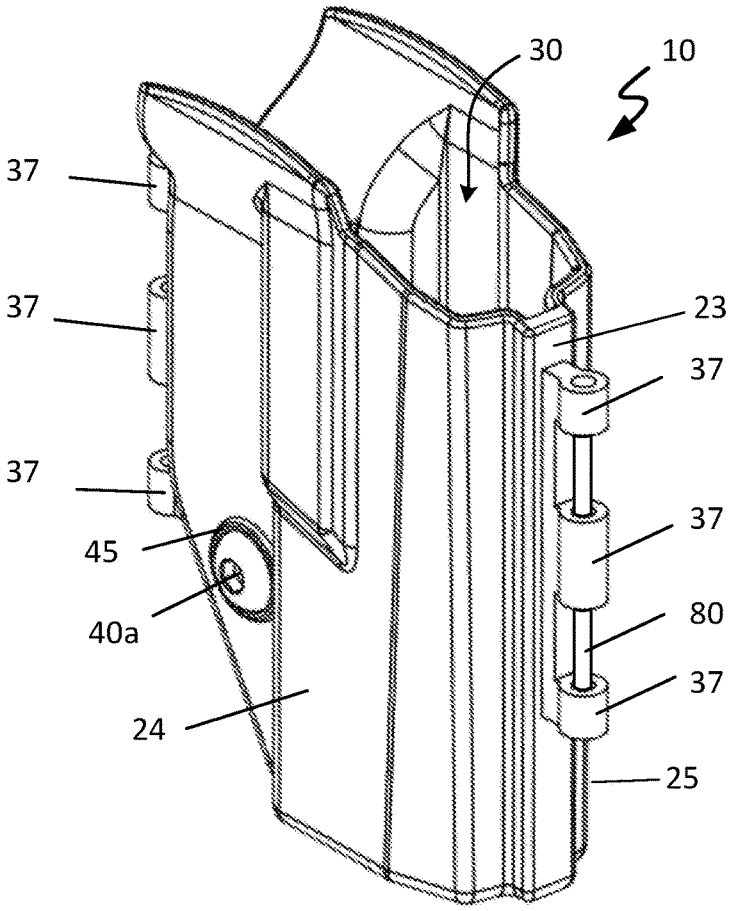
FIG. 8A is front and side perspective view of a holster body shown in FIG. 7A, in accordance with an embodiment of the present disclosure.
Figure 8B:
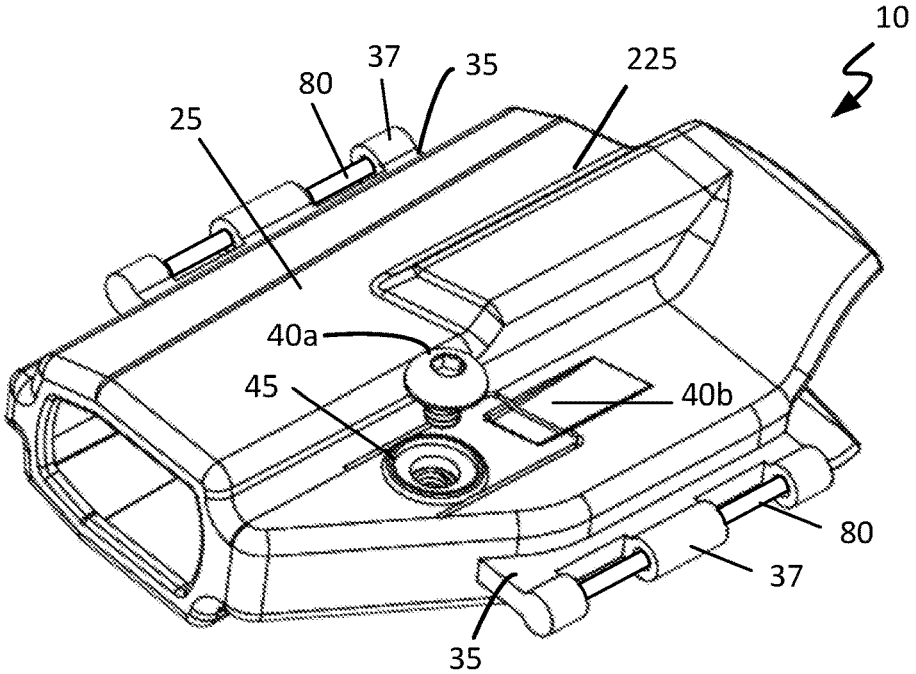
FIG. 8B is a bottom, rear, and side perspective view of the holster body of FIG. 8A, showing a retention fastener removed from the holster body, in accordance with an embodiment of the present disclosure.
Figure 8C:
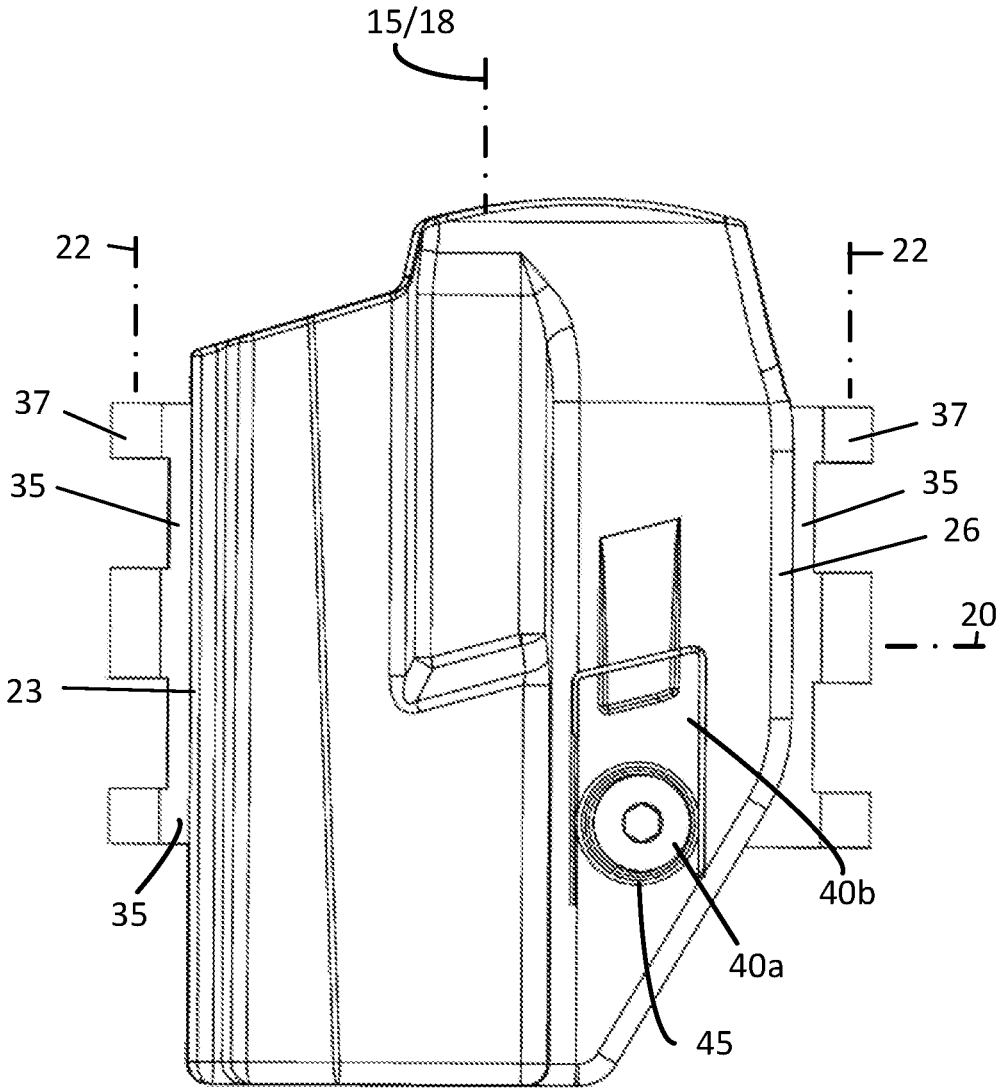
FIG. 8C is a side view of the holster body shown in FIG. 8A, in accordance with an embodiment of the present disclosure.

Referring now to FIGS. 8A-8C, the holster body 10 of FIGS. 7A-7D is shown. FIG. 8A is a front perspective view of the holster body, FIG. 8B is a bottom and rear perspective view of the holster body showing the retention member disassembled, and FIG. 8C is a side view of the holster body 10. Hinge leaves 35 extend along horizontal axis 20 from front portion 23 and rear portion 26 of holster body 10. The draw axis 18 of the holster body 10 is coincident with the vertical axis 15 when the holster body is oriented as shown in FIG. 8C. As such, the axis of rotation 22 for hinge knuckles 37 is parallel to the draw axis 18.

Holster body 10 includes one or more retention members 40 for securing the firearm within the cavity 30. For example, one retention member 40*a* is a screw extending into or through the holster body 10 behind the cavity 30 for the firearm barrel. When tightened, the retention member 40 draws together the first and second panels 24, 25 causing increased contact between the holster body 10 and the holstered firearm. In one embodiment, the screw is used with a threaded insert 45 or nut installed in the holster body 10. Another retention member 40*b* can be a protrusion that extends into the cavity 30 to engage the holstered firearm. Over time, however, the retention member 40*b* may become worn or otherwise lose some of its resiliency after repeatedly drawing and holstering the firearm. As a result, the retention member 40*b* configured as a protrusion may no longer secure the firearm within the holster body 10. To ensure that the protrusion maintains sufficient contact with the firearm, the fastener of retention member 40*a* can be tightened, for example by advancing a threaded screw, into the insert 45 to reduce the distance between opposed first and second panels 24, 25 and draw the retention member 40*b* into further contact with the firearm. This adjustment can also be used to customize the holster body 10 for firearms of varying dimensions. Numerous other retention configurations will be apparent in light of the present disclosure.

Figure 9A:
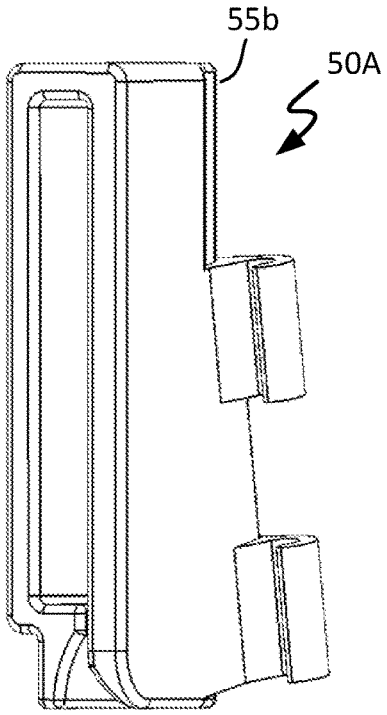
FIG. 9A is a front-end perspective view of a first waistband clip with a canted orientation as shown in FIG. 7A, in accordance with an embodiment of the present disclosure.
Figure 9B:
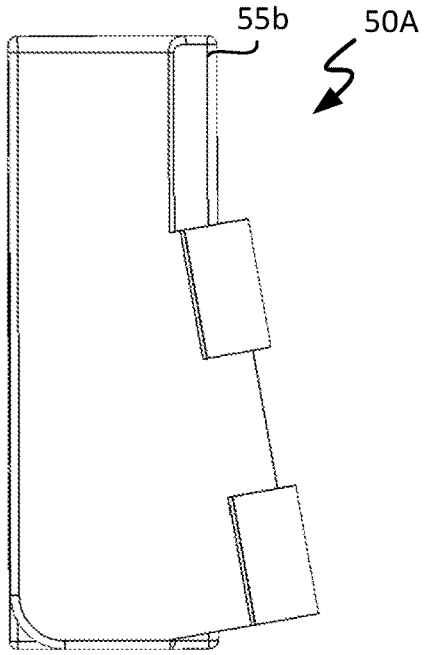
FIG. 9B is a side view of the first waistband clip shown in FIG. 9A, in accordance with an embodiment of the present disclosure.
Figure 9C:
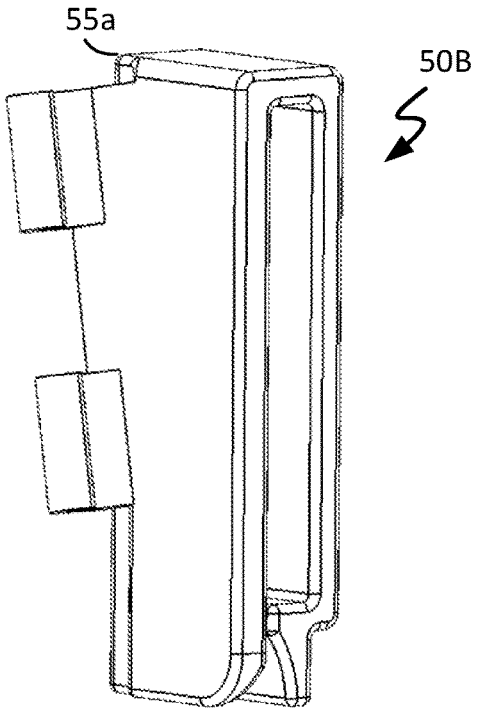
FIG. 9C is a rear-end perspective view of a second waistband clip with a canted orientation as shown in FIG. 7A, in accordance with an embodiment of the present disclosure.
Figure 9D:
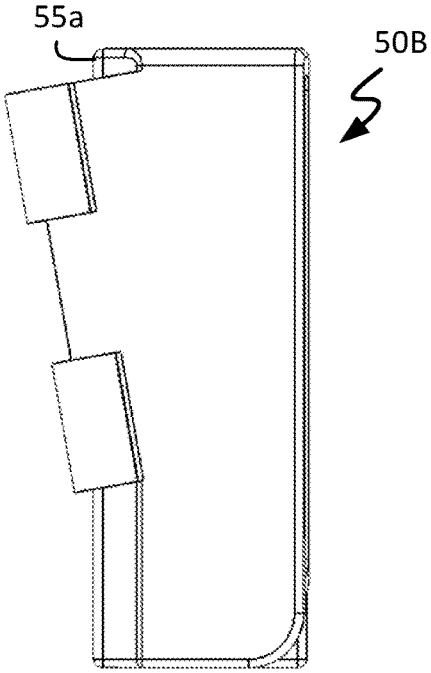
FIG. 9D is a side view of the second waistband clip of FIG. 9C.

FIGS. 9A-9D illustrate views of first and second clips 50A and 50B of the holster assembly 5 shown in FIGS. 7A-7D. FIG. 9A is a perspective view of first clip 50A showing a canted clip leaf 84 as shown in FIG. 7A, FIG. 9B is a side view of the canted clip leaf 84 of FIG. 9A. FIG. 9B is a first side view of the first clip 50A and FIG. 9C is a second side view of the first clip 50A. In the embodiments shown, the clips 50 include a clip body 55 defining a passageway 70. A clip leaf 84 extends from the clip body 55 at an angle and includes clip knuckles 60. The axis of rotation 22 through clip knuckles 60 is angled with respect to the vertical central axis 57 of the clip body 55. In some embodiments, the axis of rotation 22 is parallel to the draw axis 18 of holster body 10, such as when the holster body 10 includes canted hinge leaves 35 as shown in FIG. 7C. The clip knuckles 60 for each clip 50A and 50B are located on opposite sides (e.g., rear clip end 55*b* vs. front clip end 55*a*, respectively) and at different vertical positions along the clip body 55 so as to be positioned level with one another when attached to a horizontal belt 2 or waistband.

Since each clip leaf 84 extends from the clip body 55, the clip knuckles 60 are spaced from the clip body 55. In some embodiments, the clip knuckles 60 can be spaced 1/16, 1/8, 1/4, or 1/2 inches from the clip body 55. Clips 50 of FIGS. 9A-9D are illustrated as being openable at the lower end portion 64, but this is not required. In some embodiments, the clip knuckles 60 are configured for removal from the hinge pin 80 by defining a slot 62. The slot 62 of each clip knuckle 60 opens towards the clip body 55. When attached to the holster body 10 and positioned for use, such as shown in FIG. 7C, the clip 50 is prevented from detachment from the hinge pin 80 due to interference with the hinge leaf 35 and hinge knuckle 37 on the holster body 10. To remove a clip 50, it would be first be rotated about 90° from the position shown in FIG. 7A so that the clip knuckle 60 is free to move away from the hinge pin 80. Thus, in some embodiments, holster assembly 5 prevents inadvertent detachment of clips 50 when attached to a belt extending around one's waist because the clip 50 is very unlikely to attain the needed rotational position during use that is required for detachment of the clip 50 from the hinge pin 80.

Figure 10A:
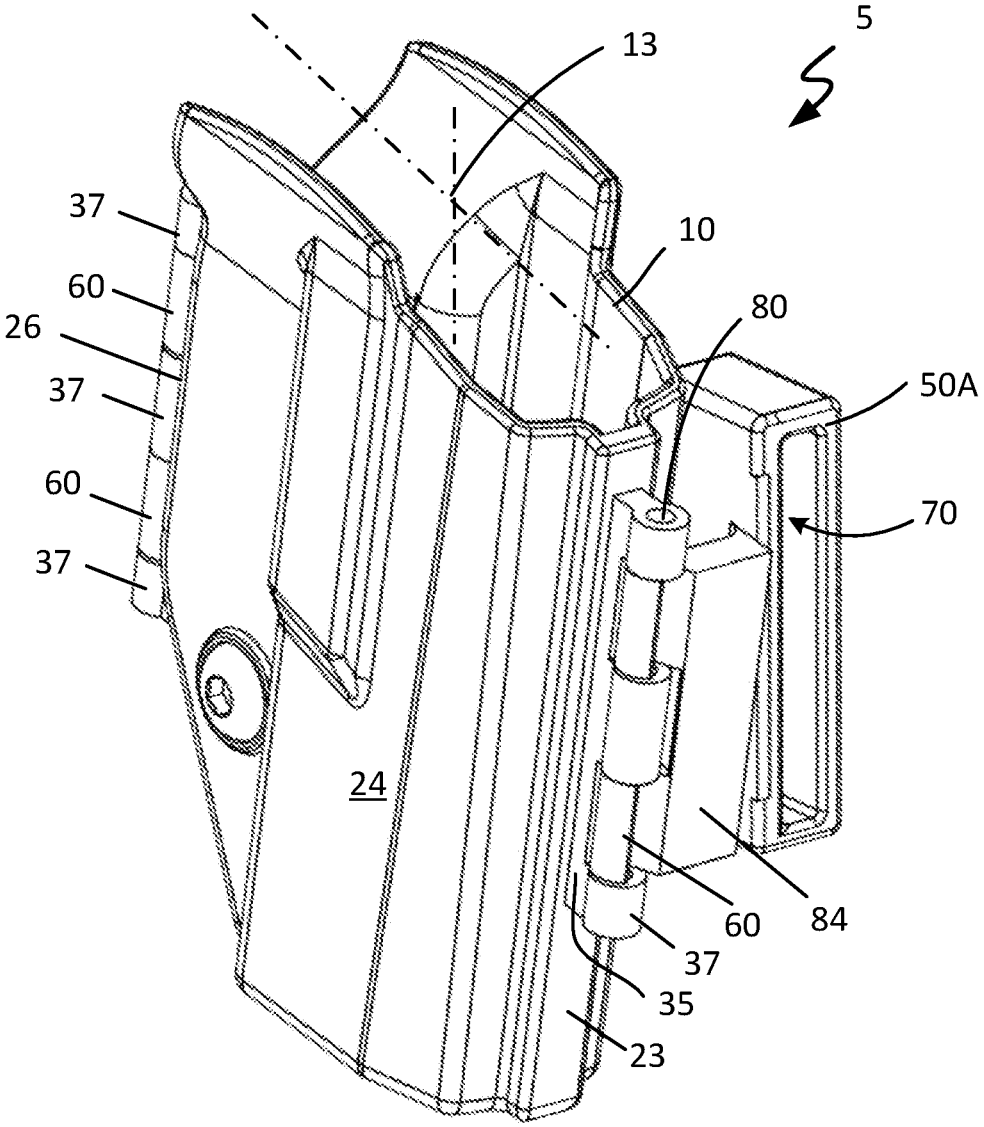
FIG. 10A is a front perspective view of an outside-the-waistband holster assembly configured for right-hand draw, in accordance with an embodiment of the present disclosure.
Figure 10B:
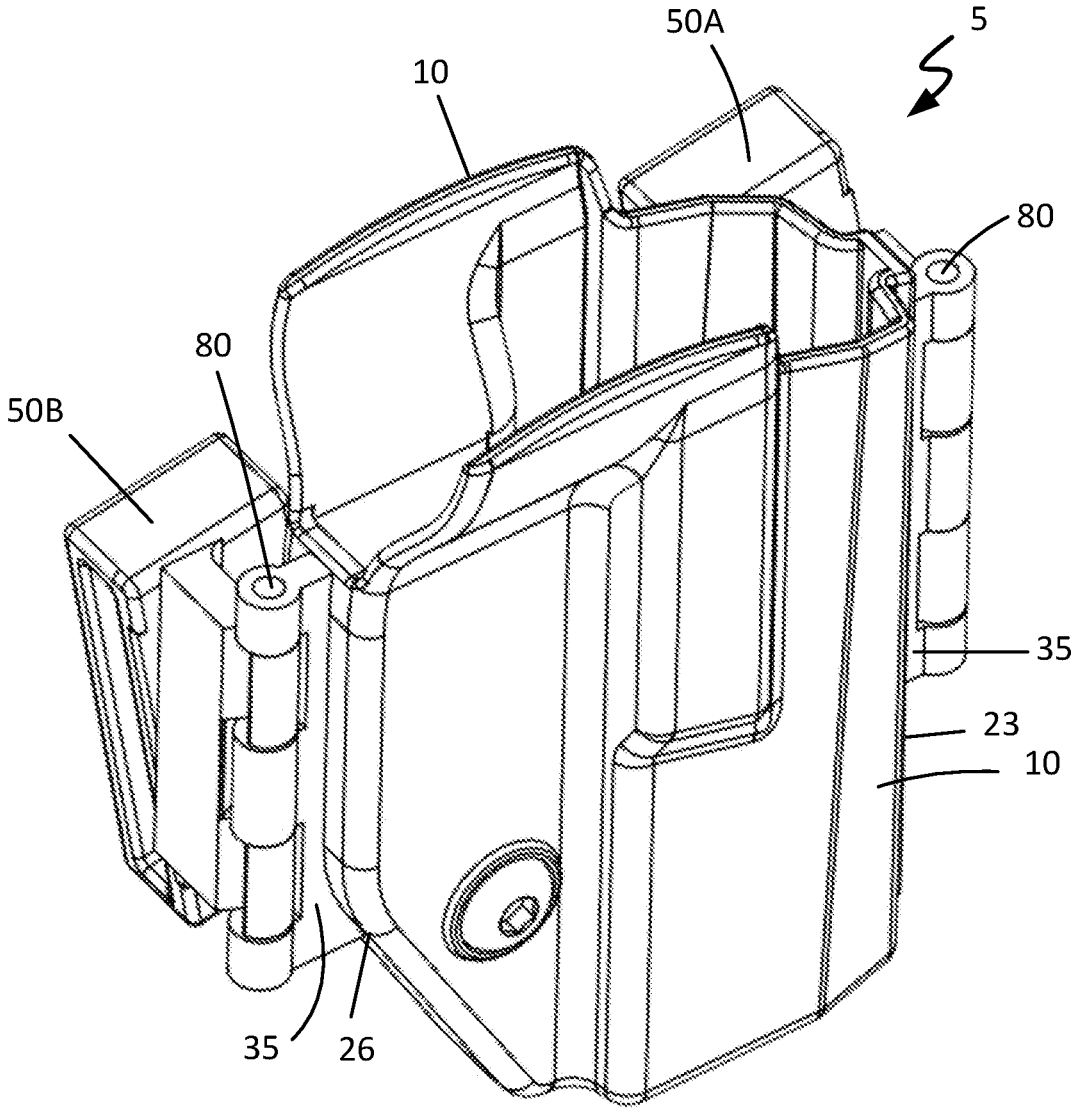
FIG. 10B is a top and side perspective view of the holster assembly of FIG. 10A showing the outside panel of the holster body, in accordance with an embodiment of the present disclosure.
Figure 10C:
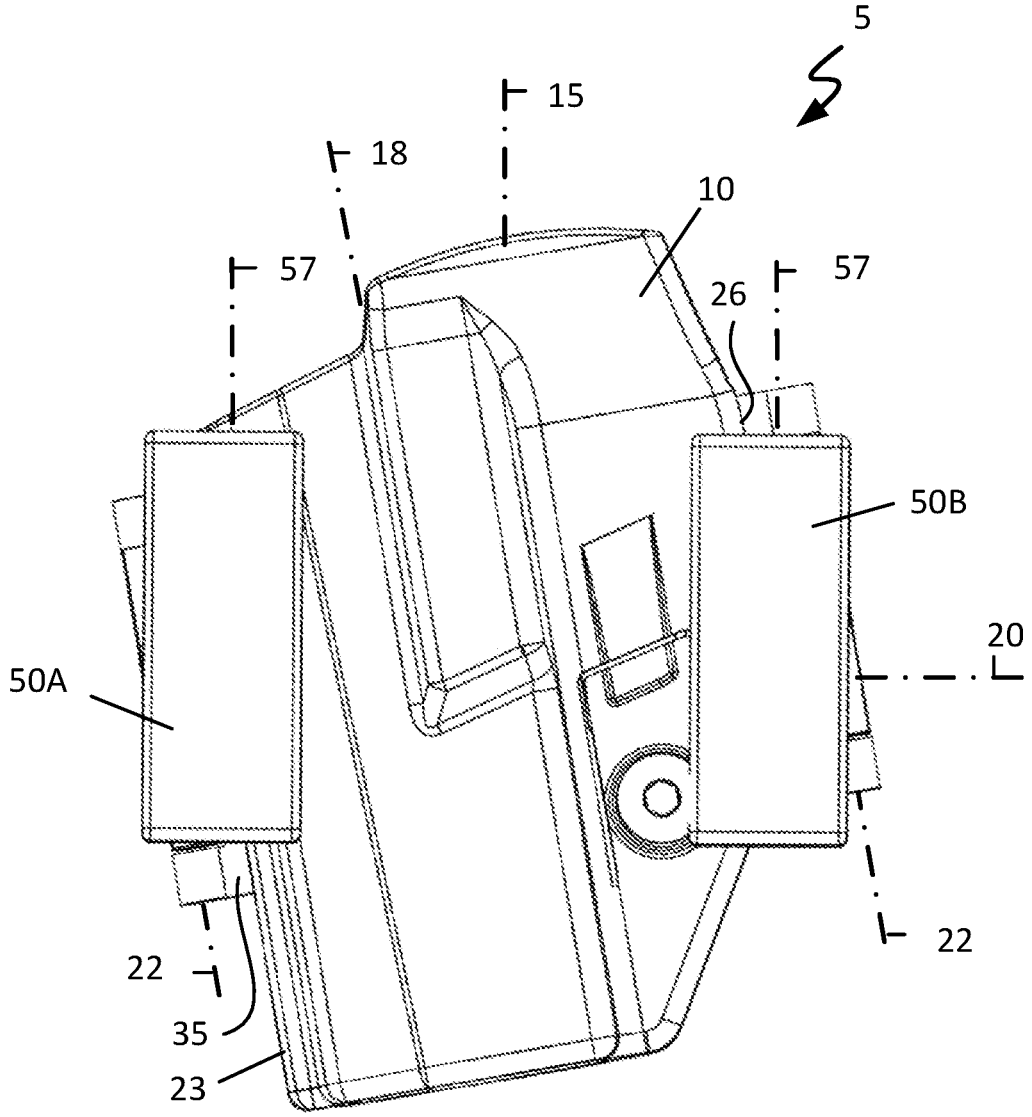
FIG. 10C is a side view of the holster assembly of FIG. 10B showing the cant of the holster body with respect to the clips, in accordance with an embodiment of the present disclosure.

Referring now to FIGS. 10A-10C, perspective views illustrate a holster assembly 5 configured for right-hand draw and OWB attachment, in accordance with embodiments of the present disclosure. FIG. 10A is a front and side perspective view showing the outside or first panel 24 of the holster assembly 5, FIG. 10B is top, rear, and side perspective view of the holster assembly 5, and FIG. 10C is a side view showing the clips 50 and second or inside panel 25 of the holster body 10. The embodiment shown in FIGS. 10A-10C has a canted configuration as determined by the configuration of the attached clips 50.

When the draw axis 18 oriented vertically, hinge leaves 35 extend horizontally from the front portion 23 and rear portion 26 of the holster body 10, in accordance with some embodiments. That is, the locations along the front portion 23 and rear portion 26 of the holster body 10 where the hinge leaves 35 attach are parallel to the draw axis 18. Thus, when non-canted clips 50 are attached, the holster body 10 will have a non-canted configuration. In contrast, when canted clips 50 are attached, as shown in FIGS. 10A-10C, the holster body will attain a canted orientation when the passageways 70 of the clips 50 are oriented along a horizontal axis (e.g., for passage of a belt 2 around one's waist). Similar to embodiments discussed above, clips 50A and 50B can be removably attached to the holster body using a hinge pin 80 extending through interleaved knuckles 37, 60.

The holster assembly 5 as shown in FIG. 10A is intended for use as a right-hand, OWB holster. However, the holster assembly 5 can be configured for either a right-hand or left-hand draw, depending on whether clips 50 have a canted or non-canted configuration. In this embodiment, the clip leaf 84 extends at an angle from both clips 50 so that the holster body 10 is canted forward when attached to a belt 2 that extends horizontally. To configure the holster assembly 5 as a left-hand holster assembly 5, clips 50 can be used that are a mirror image about the medial plane 30 of those shown. For example, instead of clip leaf 84 extending from the outside wall 68 (as shown in FIG. 10A), the clip leaf 84 would extend from the opposite inside wall 67.

Figure 11A:
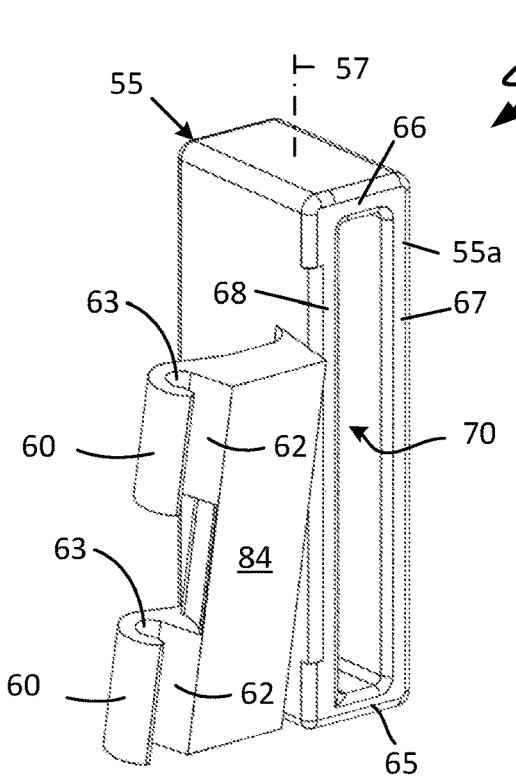
FIG. 11A is a front-end perspective view of a canted first clip shown in FIGS. 10A-10C, in accordance with an embodiment of the present disclosure.
Figure 11B:
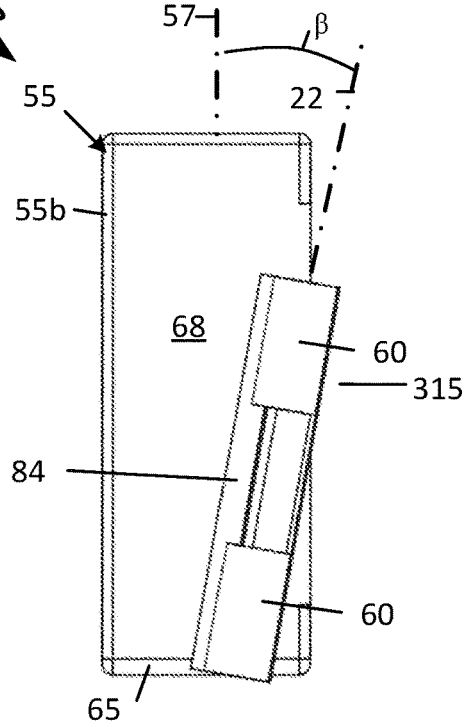
FIG. 11B is a side view of the canted first clip of FIG. 11A, in accordance with an embodiment of the present disclosure.

FIGS. 11A and 11B illustrate views of first clip 50A as shown in the embodiments of the holster assembly 5 of FIGS. 10A-10C. FIG. 11A is a perspective view and FIG. 11B is a side view showing the canted clip leaf 84. As shown in FIGS. 11A-11B, first clip 50A includes a clip body 55 defining a passageway 70 between an inside wall 67, an outside wall 68, a top wall 66, and a bottom wall 65. The clip body 55 can be openable or not. A clip leaf 84 extends generally perpendicularly away from the outside wall 68. Viewing the outside wall 68 from the side as shown in FIG. 11B, the axis of rotation 22 defines an angle $\beta$ with the central axis 57. Angle $\beta$ may be the same as angle $\alpha$ in some embodiments, resulting in the axis of rotation 22 being parallel to the draw axis 18, as discussed above. When angle $\beta$ is zero, the first clip 50A has a non-canted configuration. In contrast, the first clip 50A has a canted configuration when angle $\beta$ is from 5-30°, for example. In some embodiments, clip leaf 84 is positioned towards the forward clip end 55*a* and adjacent the bottom wall 65. Such a position places clip body 55 along the holster body 10 and minimally beyond front portion 23 when rotated to the in-use position as shown, for example, in FIG. 10A. When the first clip 50A has a non-canted configuration, placing the clip leaf 84 near the bottom wall 65 of the clip body 55 also lowers the position of the holster body 10 relative to the waistband or belt 2. When the first clip 50A has a canted configuration, placing the clip leaf 84 near the bottom wall 65 allows clip 50B to have the same vertical position, such as when the respective clip leaf 84 attaches adjacent the top wall 66. In some embodiments, each clip knuckle 60 is configured for releasable attachment to the hinge pin 80. Accordingly, in some such embodiments, the clip knuckle 60 defines a slot 62 for ingress of the hinge pin 80 to the pin opening 63. Numerous configurations will be apparent in light of the present disclosure.

Figure 11C:
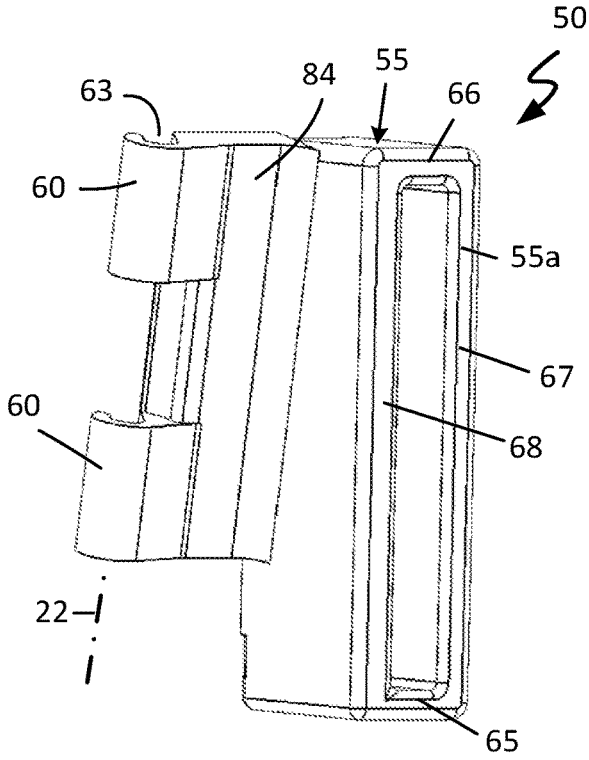
FIG. 11C is a front-end perspective view of a canted second clip shown in FIGS. 10A-10C, in accordance with an embodiment of the present disclosure.
Figure 11D:
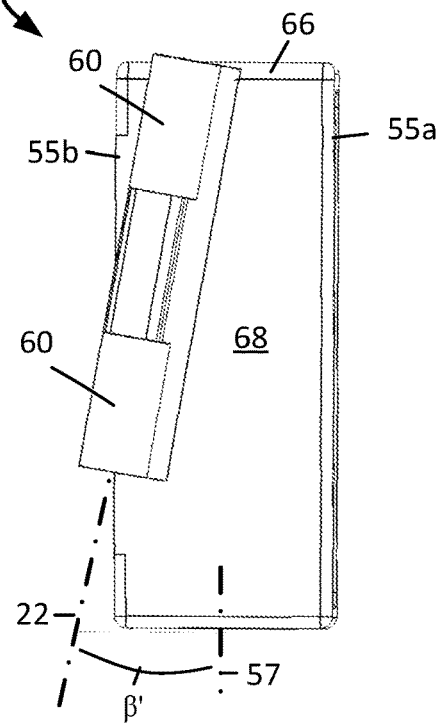
FIG. 11D is a side view of the canted second clip of FIG. 11C, in accordance with an embodiment of the present disclosure.

FIGS. 11C and 11D illustrate views of second clip 50B as shown in the embodiments of the holster assembly 5 of FIGS. 10A-10C. FIG. 11C is a perspective view and FIG. 11D is a side view showing the canted clip leaf 84. Second clip 50B in this embodiment is similar to first clip 50A, except for the position of the clip leaf 84 and direction that slot 62 opens. Here, clip leaf 84 attaches to the outside wall 68 towards the top wall 68 and rear clip end 55*b*. Slots 62 open towards the rear clip end 55*b*, rather than towards the forward clip end 55*a* as in clip 50A. Clip knuckles 60 are aligned along axis of rotation 22 that defines angle (3' with vertical central axis 57. Angle (3 is equal to angle (3' in some embodiments, but this is not required. In some embodiments, first clip 50A is identical to second clip 50B, except for being rotated 180° (e.g., flipped upside down).

Various embodiments of clips 50 can be releasably attached to the holster body 10 to configure it for left-hand or right-hand draw as desired. As shown in FIGS. 10A-10C, first clip 50A and second clip 50B are attached to holster body 10 in an inverse fashion (e.g., first clip 50A is rotated 180° relative to second clip 50B) to allow the clips 50 to rotate towards each other along the inside panel 24.

Figure 12A:
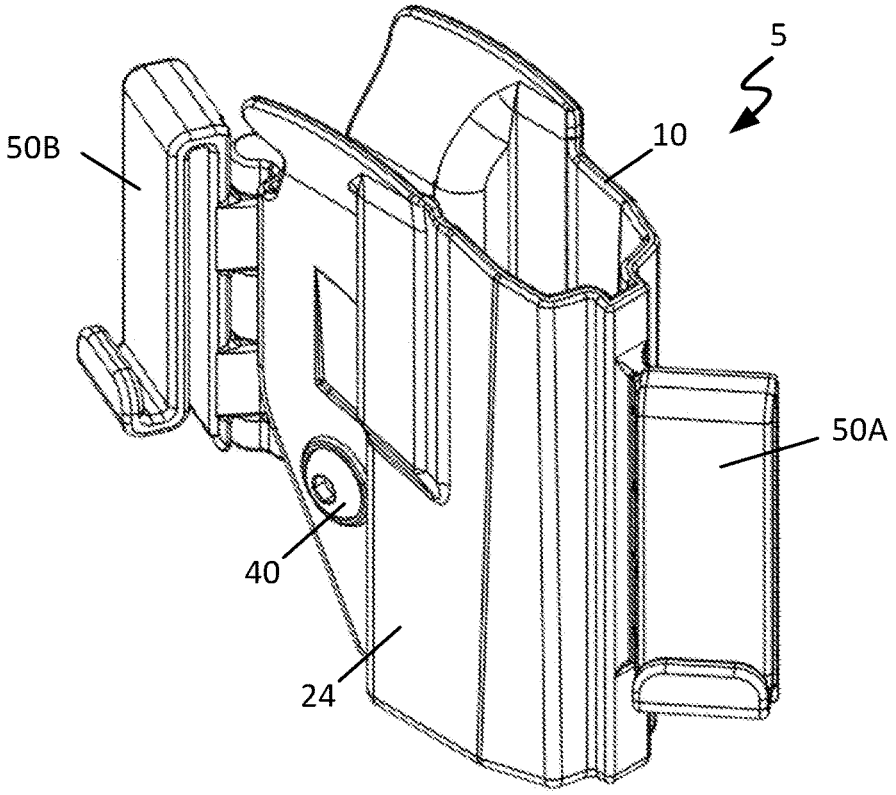
FIG. 12A is a top, front, and side perspective view of an inside-the-waistband holster assembly configured for right-hand draw, in accordance with an embodiment of the present disclosure.
Figure 12B:
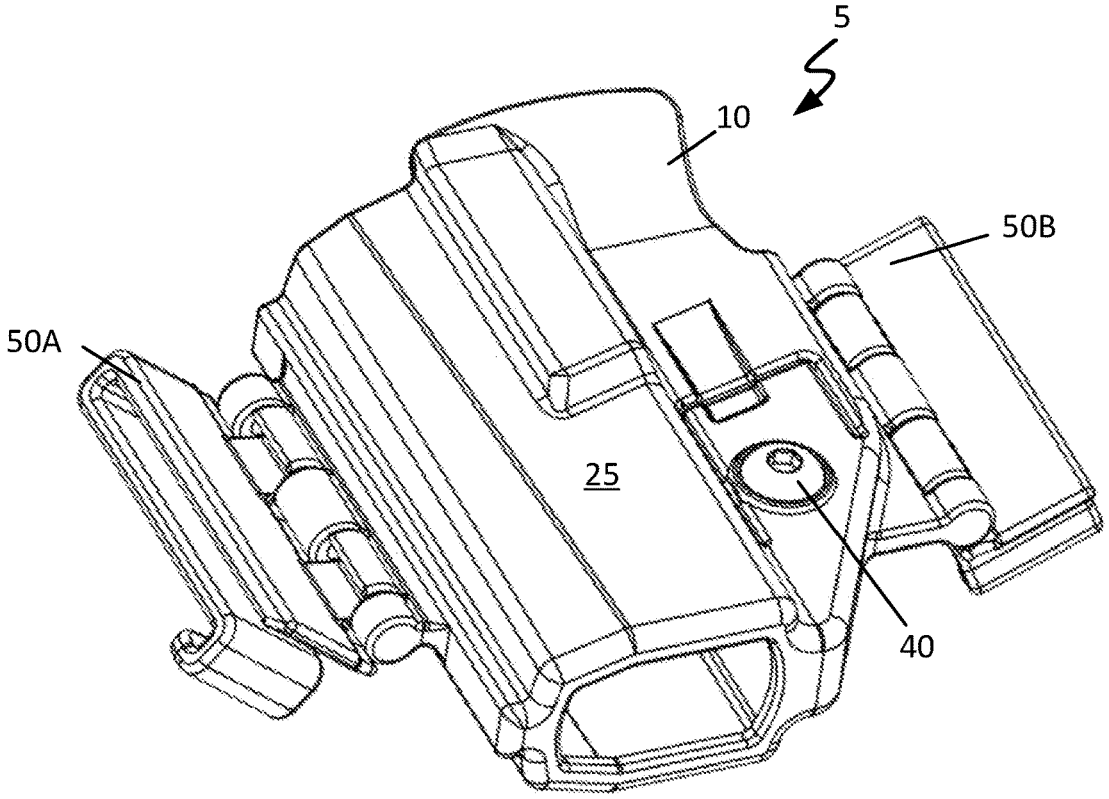
FIG. 12B is a bottom and side perspective view of the holster assembly of FIG. 12A, in accordance with an embodiment of the present disclosure.
Figure 12C:
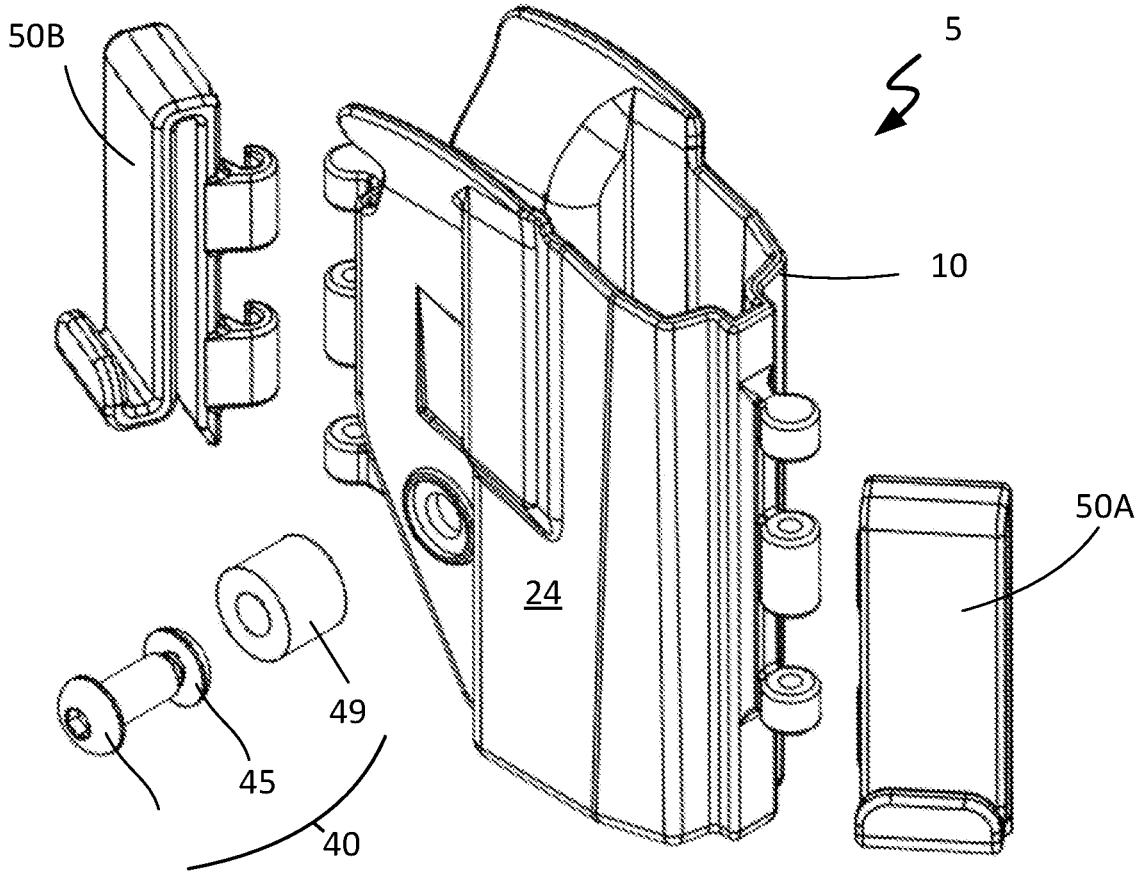
FIG. 12C is an exploded perspective view of the inside-waistband holster assembly of FIG. 12A, in accordance with an embodiment of the present disclosure.

Referring now to FIGS. 12A-12C, a holster assembly 5 having an IWB configuration may include clips 50 that engage or otherwise attaches to both a waist band and a belt, in accordance with an embodiment of the present disclosure. For example, the holster assembly 5 may include a holster body 10 (canted or non-canted) and attached clips 50 that define both a passageway for the waistband and a hook to engage the bottom edge of a belt. FIGS. 12A-12C illustrate a holster assembly 5 having an IWB configuration and including examples of such clips 50. FIG. 12A is a perspective view showing the first (outside) panel 24 of the holster assembly 5, FIG. 12B is a bottom perspective view of the holster assembly 5 showing the second (inside) panel 25, and FIG. 12C is an exploded view of the holster assembly showing the first (outside) panel 24 (hinge pins 80 omitted). As can be seen, the holster assembly 5 includes a holster body 10 with and removable clips 50. Since some features of the holster assembly 5 have been discussed above, this discussion will concentrate on other features.

In one embodiment, the holster body 10 includes one or more retention members 40. In one example, the retention member 40 includes a fastener 45 (e.g., a screw or bolt) extending into or through the holster body 10, a nut 47, and an optional bushing 49. The nut 47 can be a stove-pipe nut, a long nut or a shank nut, for example. When engaged in the nut 47, the fastener 45 can be tightened (or loosened) to increase or decrease the contact between the holster body 10 and the firearm. In some examples, a bushing 49 is installed between the first panel 24 and the second panel 25 with the fastener extending therethrough. In one example, the bushing 49 can be made of elastomeric or polymeric materials to provide a resistive force as the fastener 45 is tightened.

Figure 13A:
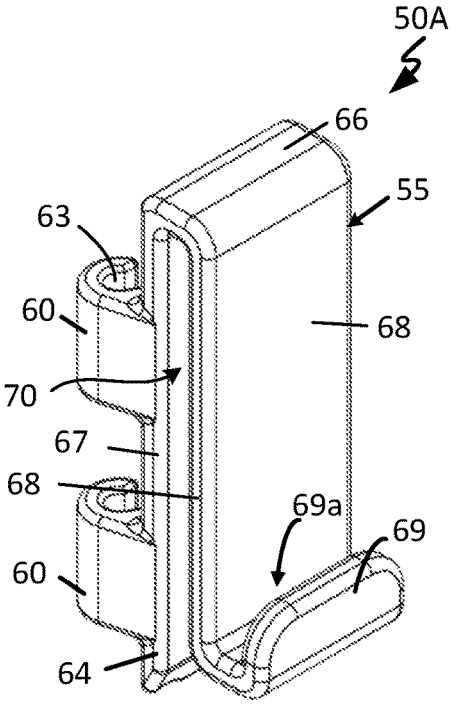
FIG. 13A is a side perspective view of a first removable waistband clip as shown in FIG. 12A, in accordance with an embodiment of the present disclosure.
Figure 13B:
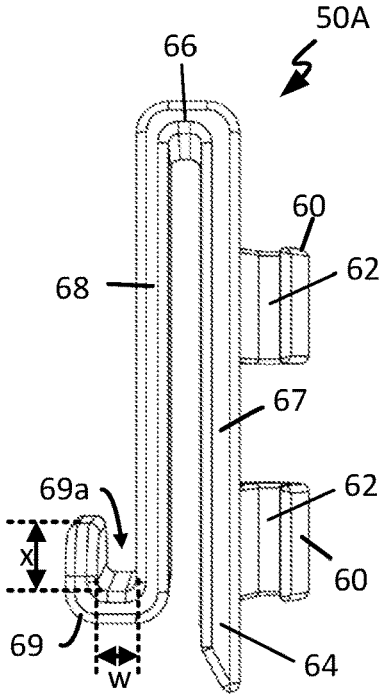
FIG. 13B a side perspective view of a second removable waistband clip as shown in FIG. 12A, in accordance with an embodiment of the present disclosure.
Figure 13C:
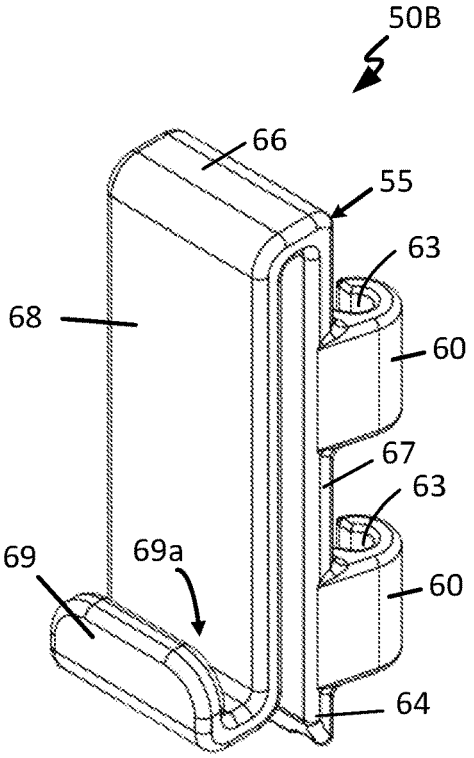
FIG. 13C is a front view of the first removable waistband clip shown in FIG. 13A
Figure 13D:
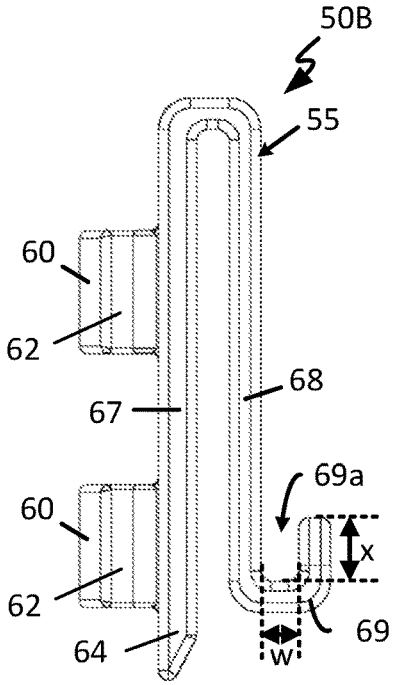
FIG. 13D is a rear view of the second removable waistband clip shown in FIG. 13B, in accordance with an embodiment of the present disclosure.

FIG. 13A is a perspective view and FIG. 13B is a side view of a first clip 50A in accordance with another embodiment of the present disclosure. FIG. 13C is a perspective view and FIG. 13D is a side view of a second clip 50B, in accordance with an embodiment of the present disclosure. As discussed above, the holster assembly 5 may include first and second removable clips 50 (e.g., first clip 50A and second clip 50B) that secure the assembly 5 to both a waist band and a belt. First clip 50A and second clip 50B are configured as mirror images of one another in some embodiments, and therefore may be interchangeable to convert the configuration of the holster assembly 5 from right-hand draw to left-hand draw and vice versa.

In one embodiment, each clip 50 includes a clip body 55 defining a passageway 70, one or more clip knuckles 60 on the clip body 55 for attaching to a hinge pin 80, and a hook 69. As previously described herein, the clip knuckle 60 can be configured with a slot 62 and pin opening 63. In some embodiments, the clip body 55 includes an inside wall 67, a top wall 66, and an outside wall 68. The clip body 55 is open or can be opened at the lower end portion 64 to receive a waistband. For example, a waistband can be inserted through the open lower end portion 64 and into the passageway 70. The hook 69 is attached to the outside wall 68 at the lower end portion 64 and curves upward from the bottom of the outside wall 68 in a J-shape. The hook 69 can be curved, rectangular, or other suitable shape to engage the bottom edge of a belt, as will be appreciated. In use, the hook 69 engages the belt 2 to prevent the holster from sliding upwardly and off of the waistband when the firearm is drawn from the holster body 10. The hook 69 can define a channel 69*a* with a width from ⅛" to ⅜", for example. In some embodiments, the hook 69 can extend vertically to approximately ⅓, ¼, ½, or ¾ the width, or the entire width of the belt. In other embodiments, the channel 69*a* has a vertical depth X from ⅛ inch to ½ inch or more. Numerous other clip configurations will be apparent in light of the present disclosure.

Figure 14:
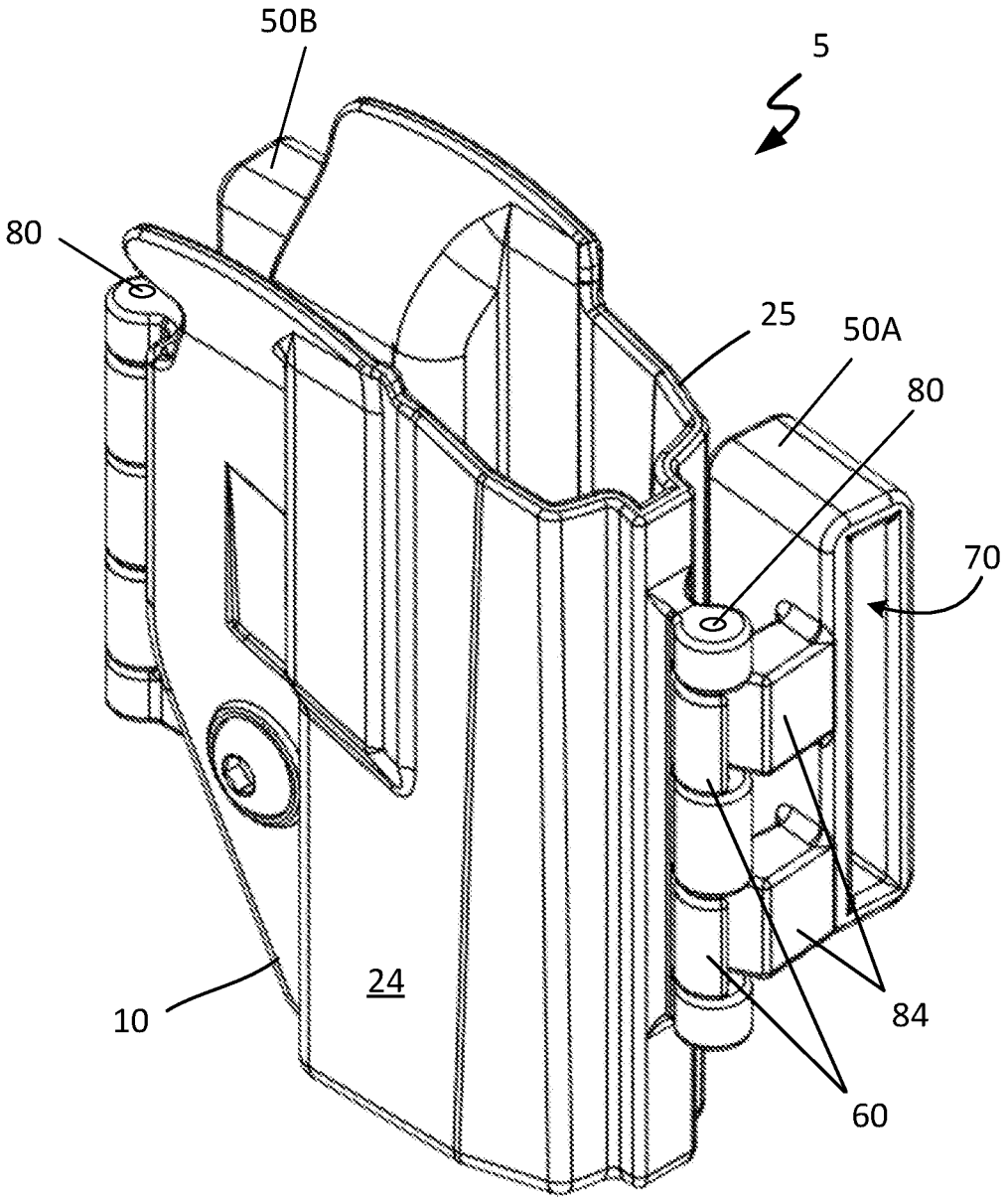
FIG. 14 is a perspective view of an outside-the-waistband holster assembly configured right-hand draw, in accordance with an embodiment of the present disclosure.

FIG. 14 is a perspective view of a holster assembly 5 configured for right-hand draw and OWB use, in accordance with another embodiment of the present disclosure. In an example embodiment, the holster assembly 5 includes a holster body 10 with first clip 50A and second clip 50B attached thereto via hinge pins 80. The holster body 10 and hinge pins 80 have been previously described herein. In this embodiment, a distinct clip leaf 84 extends from the clip body 55 for each clip knuckle 60. As shown in FIG. 14, each clip 50 is rotated about the hinge pin 80 so that the passageway 70 is along the second or inside panel 25 of the holster body 10. The clip leaves 84 can be sized to align the passageway 70 even with the second panel 25 so that a belt or extending through the passageways 70 and along the second panel 25 can follow a generally linear path. In other embodiments, the clip leaves 84 extend to impart a slight curve as the belt passes through the passageways 70 and along the second panel 25.

Figure 15:
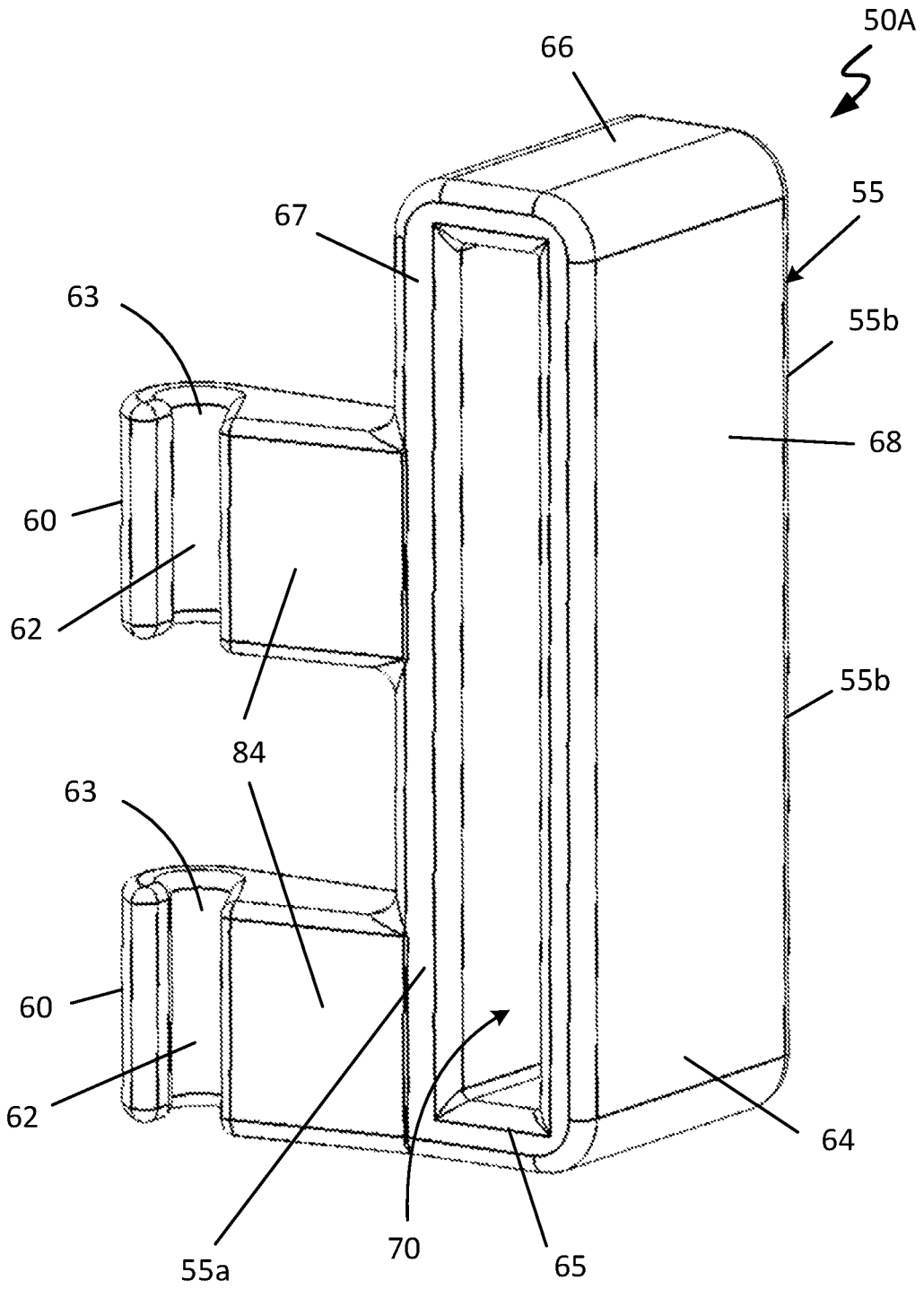
FIG. 15 is a front-end perspective view of a first belt clip shown in FIG. 14, in accordance with an embodiment of the present disclosure.

FIG. 15 is a perspective view of first clip 50A as shown in FIG. 14. Second clip 50B (shown in FIG. 14) is a mirror image of first clip 50A, in accordance with some embodiments. In the example embodiment shown, first clip 50A has a clip body 55 defining a passageway 70 between an inside wall 67, an outside wall 68, a top wall 66, and a bottom wall 65 as discussed above. The passageway 70 is shown as closed, but the clip body 55 can be configured to be open or openable at the lower clip end portion 64 as discussed above. Rather than a common clip leaf 84, individual clip leaves 84 extend from the inside wall to each clip knuckle 60. In this example embodiment, the clip knuckles 60 are configured for removable attachment to a hinge pin 80. Accordingly, the clip knuckles 60 define a pin opening 63 and a slot 62 for ingress of the hinge pin 80. The bottom clip leaf 84 is at or adjacent the bottom wall 65 of the clip body 55. When the holster assembly 5 is worn, such positioning of the clip leaves 84 enables the holster body 10 to ride lower relative to the position of a belt. In this one embodiment, the snaps 515 are positioned a distance z from each other and along one edge of the clip 505.

When assembled, each clip 50 is intended to be positioned between the second (inside) panel 25 of the holster body 10 and the person's body, with a belt passing through the passageways 70. As can be seen in FIG. 14, for example the first clip 50A is installed on the hinge pin 80 so that the slot 62 of the clip knuckles 60 faces forward of the holster body 10. Similarly, the slot 62 of second clip 50B faces rearwardly of the holster body 10. As the belt is tightened with the clips 50 in this position, the force applied to the first clips 50A and second 50B by the belt pushes the clips 50 toward the hinge pins 80. In contrast, if the clips 50 were installed so that the slot 62 opens towards the holster body 10, then the force of the belt could act to disengage or otherwise detach the clip knuckles 60 from the hinge pin 80.

In use, various clip configurations enable holster assemblies of the present disclosure to be configured for a person's draw preference (e.g., right-hand or left-hand draw), manner of carry (e.g., inside-the-waistband (IWB) or outside-the-waistband (OWB)), and desired holster orientation (canted or non-canted). The clips can be permanently, semi-permanently, or removably attached to the holster body to provide the level of flexibility in reconfiguring the holster assembly. Additionally, the holster assembly can be configured to suit the person's preferred carry position on the body. For example, a single clip can be used for appendix carry while two clips can be utilized for carrying the firearm against a person's lower back or hip. The holster assemblies, in some cases, can be provided in the form a kit, from which the assembly can be assembled in different configurations.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. A holster assembly comprising:

a holster body defining a cavity configured to receive a portion of a firearm, the holster body having a front-end portion and a rear-end portion;

a first hinge leaf on the front-end portion; and a first hinge pin attached to the first hinge leaf; and a first belt clip hingedly attached to the holster body via the first hinge pin;

a second hinge leaf on the rear-end portion of the holster body;

a second hinge pin attached to the second hinge leaf; and a second belt clip hingedly attached to the holster body via the second hinge pin.

2. The holster assembly of claim 1, wherein the first clip is rotatably attached to the first hinge pin and the second clip is rotatably attached to the second hinge pin.

3. The holster assembly of claim 1, wherein the first clip is removably attached to the first hinge pin and the second clip is removably attached to the second hinge pin.

4. The holster assembly of claim 1 further comprising:

a first hinge knuckle on the first hinge leaf, the first hinge pin extending through the first hinge knuckle;

a second hinge knuckle on the second hinge leaf, the second hinge pin extending through the second hinge knuckle;

a first clip knuckle on the first belt clip, the first clip knuckle defining a first pin opening receiving the first hinge pin therethrough; and a second clip knuckle on the second belt clip, the second clip knuckle defining a second pin opening receiving the second hinge pin therethrough.

5. The holster assembly of claim 4, wherein the first clip knuckle defines a slot along the first pin opening, the slot constructed for a snap fit with the first hinge pin, and wherein the second clip knuckle defines a slot along the second pin opening, the slot constructed for a snap fit with the second hinge pin.

6. The holster assembly of claim 1, wherein reversing a position of the first clip and the second clip converts the holster assembly between an inside-the-waist-band holster and an outside-the-waste-band holster.

7. The holster assembly of claim 1, wherein reversing a position of the first clip and the second clip converts the holster assembly between a right-hand holster and a left-hand holster.

8. The holster assembly of claim 1, wherein the first clip is interchangeable with the second clip to configure the holster as either a right-hand holster or a left-hand holster.

9. The holster assembly of claim 1, wherein when the holster assembly is attached to a belt extending horizontally, the holster body is canted forward relative to a vertical axis, and the first hinge pin extends generally parallel to the vertical axis.

10. The holster assembly of claim 1, wherein when the holster assembly is attached to a belt extending horizontally, the cavity defines a draw axis that is canted forward relative to a vertical axis, and the first hinge pin extends generally parallel to the draw axis.

11. The holster assembly of claim 1 further comprising at least one retention member disposed within the holster body.

12. The holster assembly of claim 11, wherein the at least one retention member includes a protrusion on an inside of the holster body, the protrusion extending into the cavity to engage a firearm disposed therein.

13. The holster assembly of claim 12, wherein the at least retention member includes an insert disposed in the holster body and a fastener advanceable into the insert to adjust a position of the protrusion.

14. A holster assembly comprising:

a holster body defining a cavity sized and shaped to receive a portion of a handgun with a barrel of the handgun extending downward into the cavity, the body having a front portion, a rear portion opposite the front portion, a first side panel between the front portion and the rear portion, and a second side panel spaced from and opposite the first side panel, wherein when the handgun is installed in the holster body, a top of the barrel extends along the front portion of the holster body;

a belt clip configured to hingedly attach along the front portion of the holster body;

a hinge leaf on the front portion of the holster body, the hinge leaf including a hinge knuckle defining a pin opening;

a clip knuckle on the belt clip, the clip knuckle defining a pin opening constructed to align with the pin opening of the hinge knuckle when the belt clip is attached to the holster body; and a hinge pin extending at least partially through the pin opening of the hinge knuckle and the pin opening of the clip knuckle when the belt clip is attached to the holster body.

15. The holster assembly of claim 14, wherein the belt clip is removably attachable to the holster body.

16. The holster assembly of claim 14, wherein the clip knuckle defines a slot along the pin opening, the slot configured to receive the hinge pin therethrough and sized for a snap fit to the hinge pin.

17. The holster assembly of claim 14, wherein the belt clip has a clip body defining a passageway therethrough, and the belt clip further comprises a clip leaf extending between the clip body and the clip knuckle.

18. The holster assembly of claim 14, wherein the cavity defines a draw axis and the hinge pin extends generally parallel to the draw axis.

19. The holster assembly of claim 18, wherein the draw axis is generally parallel to a vertical axis when the holster assembly is attached to a belt extending horizontally.

20. The holster assembly of claim 14, wherein the holster body defines a draw axis defining an angle from 5° to 30° with respect to a vertical axis when the holster assembly is attached to a belt extending horizontally, and wherein the hinge pin extends parallel to the vertical axis.

21. A kit for a holster assembly, the kit comprising a combination of:

a holster body defining a cavity to receive a portion of a firearm, the holster body further comprising a first hinge leaf extending from a front end of the holster body and a second hinge leaf connected to a rear end of the holster body; and a first set of removable clips each defining a passageway configured to receive a belt through the passageway, the first set of removable clips comprising a first removable clip configured to pivotably attach to either of the first hinge leaf and the second hinge leaf; and a second removable clip configured to pivotably attach to either of the first hinge leaf and the second hinge leaf.

22. The kit of claim 21 further comprising:

a second set of removable clips each defining a passageway configured to receive a waistband therein, the second set of removable clips comprising a third removable clip configured to pivotably attach to either of the first hinge leaf and the second hinge leaf; and a forth removable clip configured to pivotably attach to either of the first hinge leaf and the second hinge leaf.

23. The kit of claim 22, wherein the holster assembly can be configured as an inside-the-waist-band holster or an outside-the-waistband holster based on whether the first set of removable clips or the second set of removable clips are attached to the holster body.

24. The kit of claim 21, wherein the holster assembly can be reconfigured between a right-hand holster and a left-hand holster by reversing a position of the first removable clip and the second removable clip when the first set of removable clips are attached to the holster body.

25. The kit of claim 22, wherein individual clips of at least one of the first set of removable clips and the second set of removable clips are interchangeable to configure the holster body as either a right-hand holster or a left-hand holster.

* * * * *